US010844606B2

(12) United States Patent
Lavery et al.

(10) Patent No.: US 10,844,606 B2
(45) Date of Patent: Nov. 24, 2020

(54) TIMBER FRAME STRUCTURE WITH ARCHED ROOF

(71) Applicants: Bradley Jay Lavery, Eagle Mountain, UT (US); Joseph Hyrum Thompson, Eagle Mountain, UT (US)

(72) Inventors: Bradley Jay Lavery, Eagle Mountain, UT (US); Joseph Hyrum Thompson, Eagle Mountain, UT (US)

( * ) Notice: Subject to any disclaimer, the term of this patent is extended or adjusted under 35 U.S.C. 154(b) by 0 days.

(21) Appl. No.: 16/156,024

(22) Filed: Oct. 10, 2018

(65) Prior Publication Data

US 2020/0115908 A1 Apr. 16, 2020

(51) Int. Cl.

| | |
|---|---|
| ***E04F 10/08*** | (2006.01) |
| ***E04H 6/02*** | (2006.01) |
| ***E04H 1/12*** | (2006.01) |

(52) U.S. Cl.

CPC ..... *E04F 10/08* (2013.01); *E04H 1/1205* (2013.01); *E04H 6/025* (2013.01)

(58) Field of Classification Search

CPC ..... E04F 10/08; E04F 10/00; E04F 10/005; E04H 1/1205; E04H 15/58; E04H 6/025; E04B 1/32

See application file for complete search history.

(56) References Cited

U.S. PATENT DOCUMENTS

| | | | | |
|---|---|---|---|---|
| 1,533,724 A | | 4/1925 | Clarke-James | |
| 2,008,087 A | | 7/1935 | Stromberg | |
| 2,793,407 A | | 5/1957 | Johnston | |
| 3,082,492 A | | 3/1963 | Wayne | |
| 3,685,866 A | | 8/1972 | Patenaude | |
| D224,702 S | | 9/1972 | Gordon | |
| 4,015,397 A | | 4/1977 | Flachbarth et al. | |
| 4,019,298 A | * | 4/1977 | Johnson, IV | E04B 1/185 52/590.1 |
| D293,934 S | | 1/1988 | Lambert et al. | |
| 4,894,963 A | | 1/1990 | Campbell | |
| 5,170,600 A | | 12/1992 | Terrell | |
| 5,244,300 A | | 9/1993 | Perreira et al. | |
| 5,263,288 A | * | 11/1993 | Yang | E04D 3/08 52/489.1 |
| 5,323,584 A | | 6/1994 | Scarlett | |
| 5,873,202 A | | 2/1999 | Parks | |
| 6,061,991 A | | 5/2000 | Dahl | |

(Continued)

FOREIGN PATENT DOCUMENTS

| | | |
|---|---|---|
| JP | D1487537 | 1/2006 |
| KR | 300649588 | 6/2012 |

OTHER PUBLICATIONS

WES1ERN Timber Frame; "Installation Manual Arched Knee Brace Kit;" (2018); 2 pages.

*Primary Examiner* — Andrew J Triggs
(74) *Attorney, Agent, or Firm* — Thorpe North & Western LLP

(57) ABSTRACT

A timber frame structure includes a plurality of support posts. A first mounting surface extends between a first pair of the plurality of support posts and a second mounting surface extends between a second pair of the plurality of support posts. A plurality of arches is mounted to the structure at the first mounting surface and the second mounting surface. Each of the plurality of arches is self-supporting and comprises a first curved rafter and a second curved rafter connected at a key beam.

7 Claims, 30 Drawing Sheets

(56) References Cited

U.S. PATENT DOCUMENTS

| | | | | |
|---|---|---|---|---|
| D475,468 | S | 6/2003 | Stein | |
| D485,367 | S | 1/2004 | Skulsky | |
| D504,728 | S | 5/2005 | Semi | |
| 7,000,355 | B2 | 2/2006 | Flory et al. | |
| 7,021,879 | B2 | 4/2006 | Taneichi | |
| D532,116 | S | 11/2006 | Merritt | |
| 7,287,929 | B1 | 10/2007 | Sokolowski et al. | |
| D602,602 | S * | 10/2009 | Sears | D25/57 |
| D603,058 | S * | 10/2009 | Sears | D25/57 |
| D622,871 | S | 8/2010 | Rowlinson | |
| 7,807,924 | B2 | 10/2010 | Wurzer | |
| 7,968,805 | B2 | 6/2011 | Montgelas et al. | |
| 8,089,747 | B2 | 1/2012 | Storck et al. | |
| D688,386 | S | 8/2013 | Donnelly et al. | |
| 8,584,401 | B2 | 11/2013 | Planck et al. | |
| D759,903 | S | 6/2016 | Justiniano | |
| D788,941 | S | 6/2017 | Bedford | |
| 9,797,149 | B2 * | 10/2017 | Lavery | E04H 1/1205 |
| 10,053,861 | B2 * | 8/2018 | Lavery | E04C 3/36 |
| 10,132,074 | B2 * | 11/2018 | Pace | E04B 1/2612 |
| 2004/0148900 | A1 | 8/2004 | Overaas et al. | |
| 2011/0197536 | A1 * | 8/2011 | Clark | E04F 10/08 52/650.1 |
| 2013/0263554 | A1 | 10/2013 | Verhaeghe | |
| 2016/0010321 | A1 * | 1/2016 | Lavery | E04H 1/1205 52/656.9 |
| 2017/0025836 | A1 * | 1/2017 | Lavery | E04C 3/42 |
| 2017/0335595 | A1 * | 11/2017 | Pan | E04H 15/58 |

* cited by examiner

TIMBER FRAME STRUCTURE WITH ARCHED ROOF

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. The Field of the Present Disclosure

The present disclosure relates generally to structures, and more particularly, but not necessarily entirely, to timber frame structures.

2. Description of Related Art

Modern timber frame structures provide structural soundness as well an aesthetically pleasing look. Timber framing can be utilized for both, interior framing of residential and commercial buildings and for outdoor-frame structures. More recently, there has been a resurgence in the popularity of outdoor timber frame structures constructed from heavy timbers, including pergolas, pavilions and patio covers. In its most basic form, an outdoor timber frame structure comprises one or more vertical support posts. Horizontal support beams may extend between pairs of the vertical support posts. The horizontal support beams may in turn support a desired roof or covering for providing shade and weather protection. Often times, these outdoor timber frame structures are sold as kits. These kits include pre-manufactured timber components that may be assembled onsite to form the structure. Timber frame kits have the advantage that they may be assembled easily and quickly without the need of professional help or heavy equipment in most cases.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
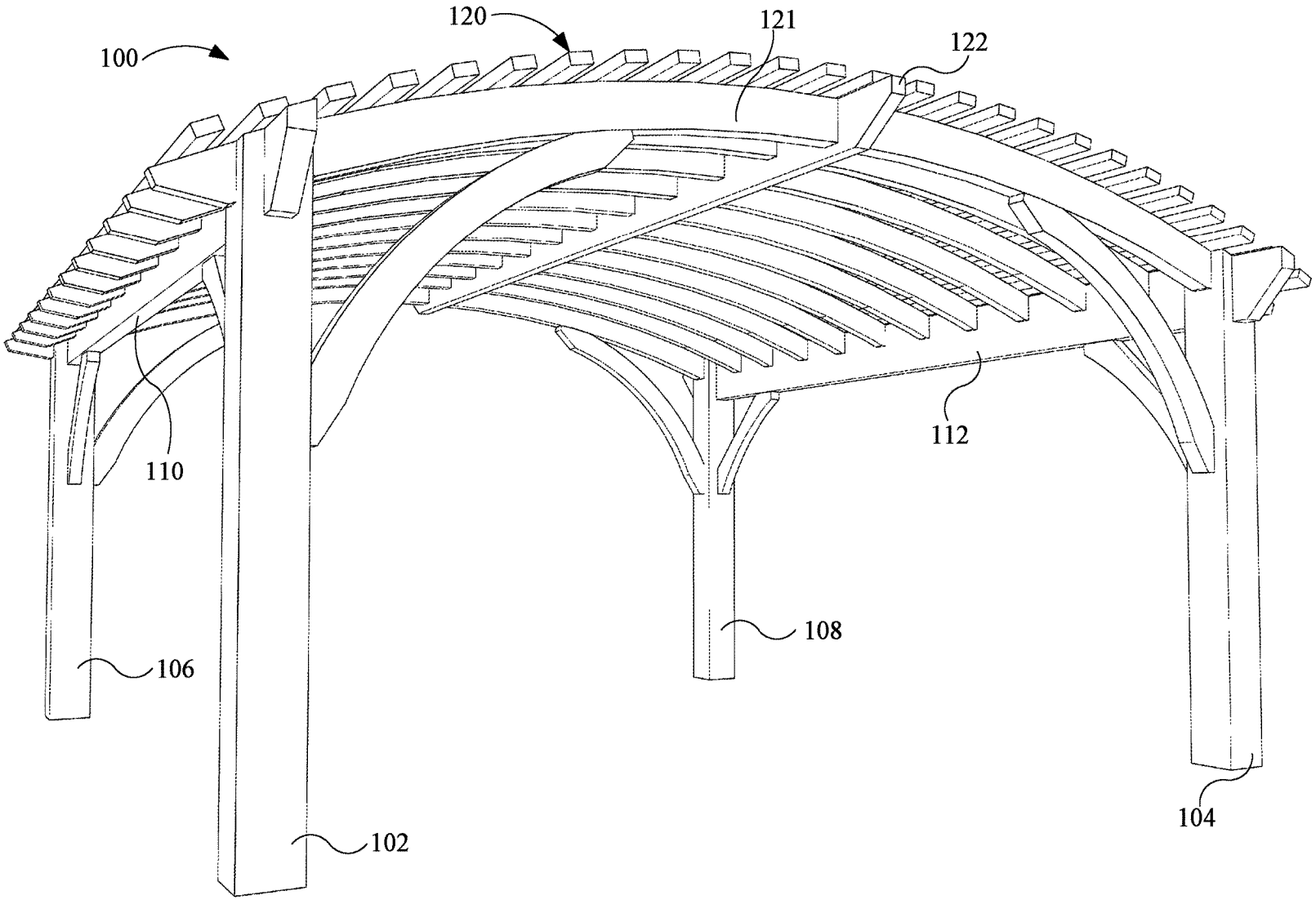
FIG. 1 is a perspective view of a timber frame structure with an arched roof according to an embodiment of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

In describing and claiming the present disclosure, the following terminology will be used in accordance with the definitions set out below. As used in this specification and the appended claims, the singular forms "a," "an," and "the" include plural referents unless the context clearly dictates otherwise. As used herein, the terms "comprising," "having," "including," "containing," "characterized by," and grammatical equivalents thereof are inclusive or open-ended terms that do not exclude additional, unrecited elements or method steps.

It is an objective of the present disclosure to provide a timber frame structure with an arched roof. The arched roof may include a plurality of arches. Each of the arches includes a first curved rafter and a second curved rafter joined at a key beam located at the apex of the arch. The arches are self-supporting. Disposed on the arches are a plurality of top planks.

It is an objective of the present disclosure to provide a timber frame structure comprising a plurality of support posts, a first mounting surface extending between a first pair of the plurality of support posts; a second mounting surface extending between a second pair of the plurality of support posts; a plurality of arches; and each of the arches having a first end and a second end; wherein the first end of each of the plurality of arches are joined to the first mounting surface and the second end of each of the plurality of arches are joined to the second mounting surface.

It is an objective of the present disclosure to provide a timber frame structure comprising a plurality of support posts; a first mounting surface extending between a first pair of the plurality of support posts; a second mounting surface extending between a second pair of the plurality of support posts; a plurality of arches, each of the arches having an apex; each of the arches comprising a first curved rafter and a second curved rafter; each of the first curved rafters having a first end and a second end; each of the second curved rafters having a first end and a second end; and a key beam disposed at the apex of the plurality of arches; wherein the first end of each of the first curved rafters is joined to the key beam; wherein the first end of each of the second curved rafters is joined to the key beam; wherein the second end of each of the first curved rafters is joined to the first mounting surface; wherein the second end of each of the second curved rafters is joined to the second mounting surface.

It is an objective of the present disclosure to provide a method of assembly a timber frame structure comprising: installing a plurality of support posts; installing a first mounting surface and a second mounting surface to the plurality of support posts; and installing a plurality of arches, each of the plurality of arches comprising a first end joined to the first mounting surface and a second end joined to the second mounting surface.

Referring now to FIG. 1, there is depicted a structure 100 according to an embodiment of the present disclosure. The structure 100 has the general form of a pergola, although it will be appreciated that the structure may comprise other types of wooden structures. In an embodiment, the structure 100 is pre-manufactured as a kit that is assembled onsite. That is, the structure 100 may be pre-fabricated off site and sold as a kit. The purchaser may either assemble the kit themselves or with the assistance of professional installers.

The structure 100 comprises a plurality of posts 102, 104, 106, and 108. Extending between the posts 102 and 106 is a first support beam 110. Extending between the posts 104 and 108 is a second support beam 112. The first support beam 110 and the second support beam 112 are spaced apart and are parallel with each other. The first support beam 110 and the second support beam 112 extend along the sides of the structure 100, from front to back.

Supported by the posts 102, 104, 106, and 108 is a roof assembly 120. The roof assembly 120 includes a key beam 122 extending from the front to the back of the structure 100. The key beam 122 is disposed at approximately the center between the posts 102 and 104 and is parallel to the first support beam 110 and the second support beam 112. The roof assembly 120 further comprises a plurality of arches 121 extending perpendicularly to the key beam 122. The plurality of arches 121 are arranged from the front to the back of the structure 100. It will be appreciated that the arches 121 are aesthetically pleasing to a user.

Figure 4:
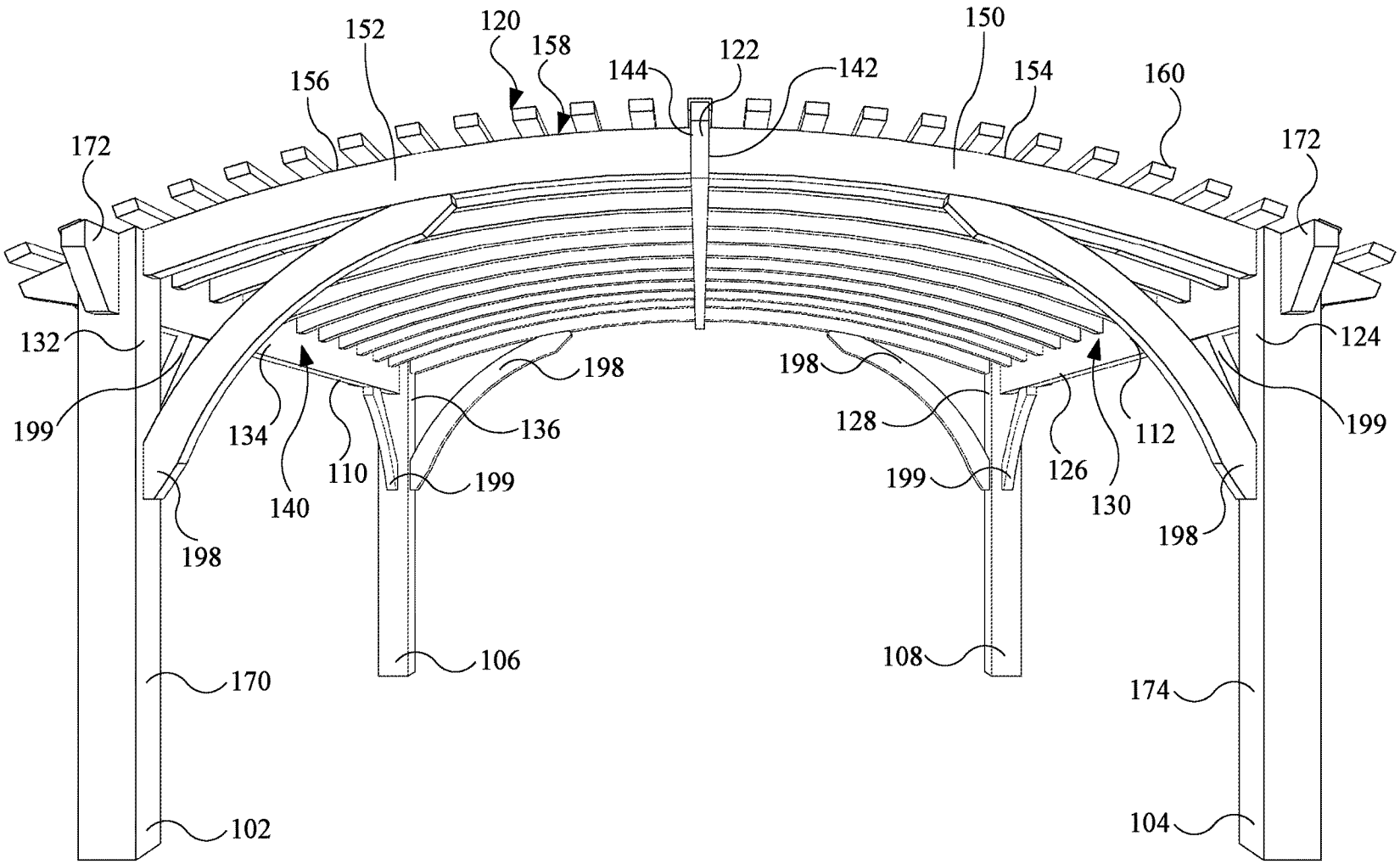
FIG. 4 is a front view of the timber frame structure shown in FIG. 1.

Referring now to FIG. 4, an inner side 124 of the post 104, an inner side 126 of the second support beam 112, and an inner side 128 of the post 108 form a first mounting surface 130 that extends from the front to the back of the structure 100. An inner side 132 of the post 102, an inner side 134 of the first support beam 110, and an inner side 136 of the post 106 form a second mounting surface 140 that extends from the front to the back of the structure 100.

Extending between a first, side 142 of the key beam 122 and the first mounting surface 130 are a plurality of curved rafters 150. Extending between a second side 144 of the key beam 122 and the second mounting surface 140 are a plurality of curved rafters 152. The curved rafters 150 and the curved rafters 152 are perpendicular to the key beam 122 and the first support beam 110 and the second support beam 112. Corresponding paired ones of the curved rafters 150 and the curved rafters 152 for an arch 121 as shown in FIG. 1.

A top edge 154 of each of the curved rafters 150 and a top edge 156 of each of the curved rafters 152 collectively form a curved mounting surface 158. A plurality of top planks 160 are mounted to the curved mounting surface 158. The plurality of top planks 160 are mounted parallel to the first support beam 110, the second support beam 112 and the key beam 122. The plurality of top planks 160 extend from the front to the back of the structure 100. Each of the plurality of top planks 160 are separated from adjacent ones by a gap roughly the same width as the top planks 160.

Figure 5:
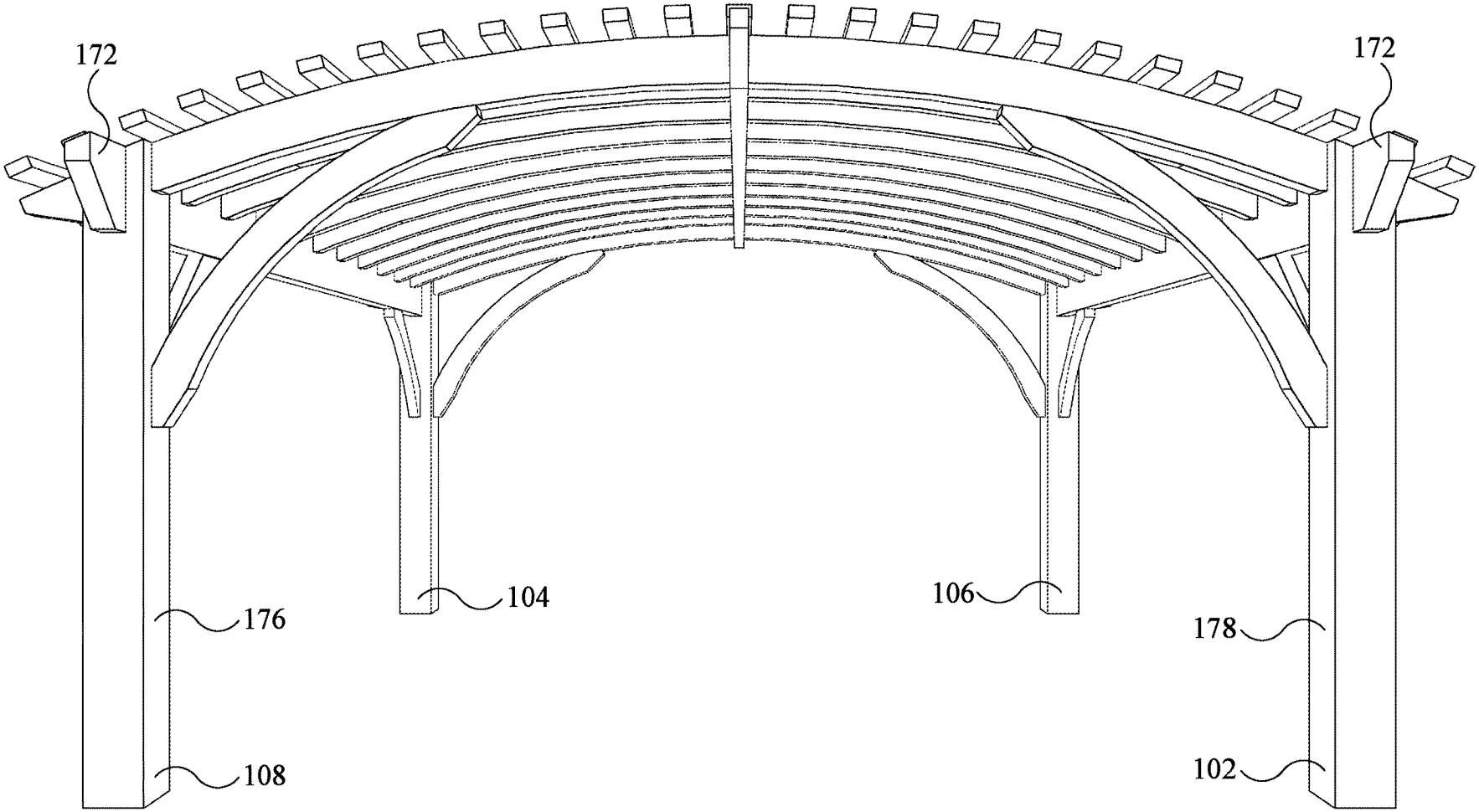
FIG. 5 is a rear view of the timber frame structure shown in FIG. 1.

Extending from a front surface 170 of the post 102 is a corbel 172. Extending from a front surface 174 of the post 104 is a corbel 172. Referring to FIG. 5, extending from a rear surface 176 of the post 108 is a corbel 172. Extending from a rear surface 178 of the post 102 is a corbel 172.

Figure 6:
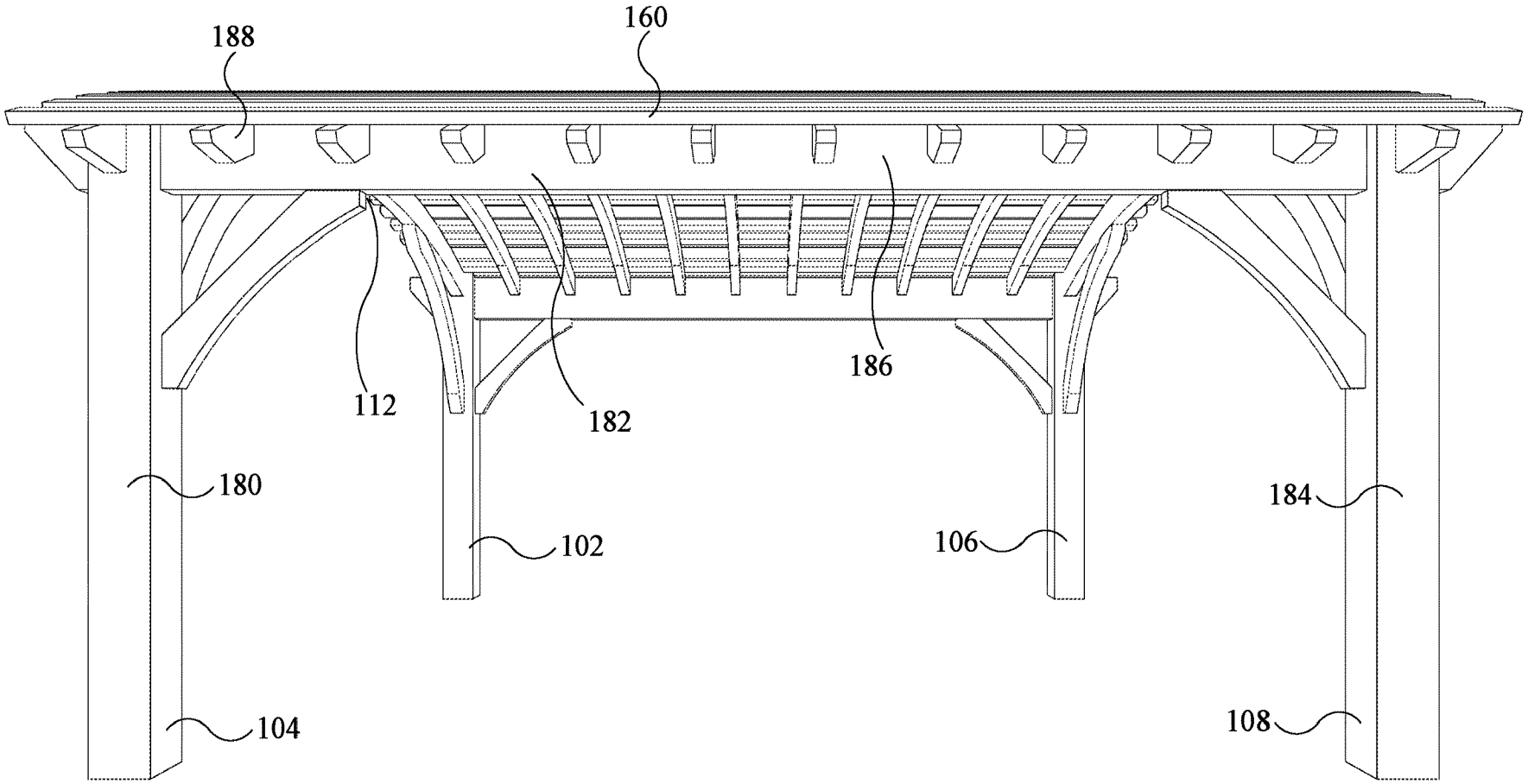
FIG. 6 is a right-side view of the timber frame structure shown in FIG. 1.

Referring to FIG. 6, an outer surface 180 of the post 104, an outer surface 182 of the second support beam 112, and an outer surface 184 of the post 108 collectively form a third mounting surface 186. A plurality of corbels 188 are mounted to the third mounting surface 186. A top plank 160 is mounted to a top surface of the plurality of corbels 188 and extends from the front to the back of the structure 100.

Figure 7:
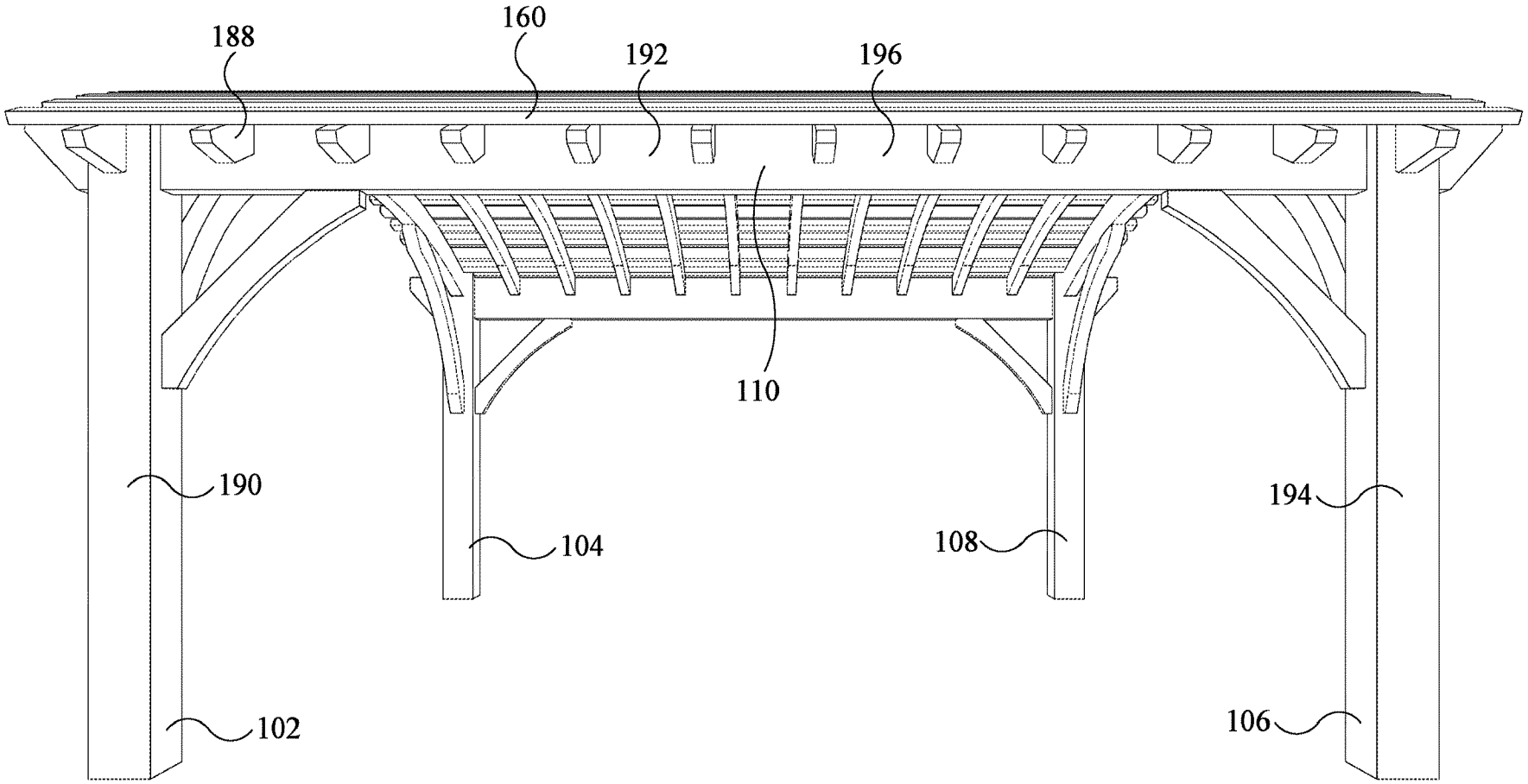
FIG. 7 is a left-side view of the timber frame structure shown in FIG. 1.

Referring to FIG. 7, an outer surface 190 of the post 102, an outer surface 192 of the first support beam 110, and an outer surface 194 of the post 106 collectively form a fourth mounting surface 196. A plurality of corbels 188 are mounted to the fourth mounting surface 196. A top plank 160 is mounted to a top surface of the plurality of corbels 188 and extends from the front to the back of the structure 100.

Figure 2:
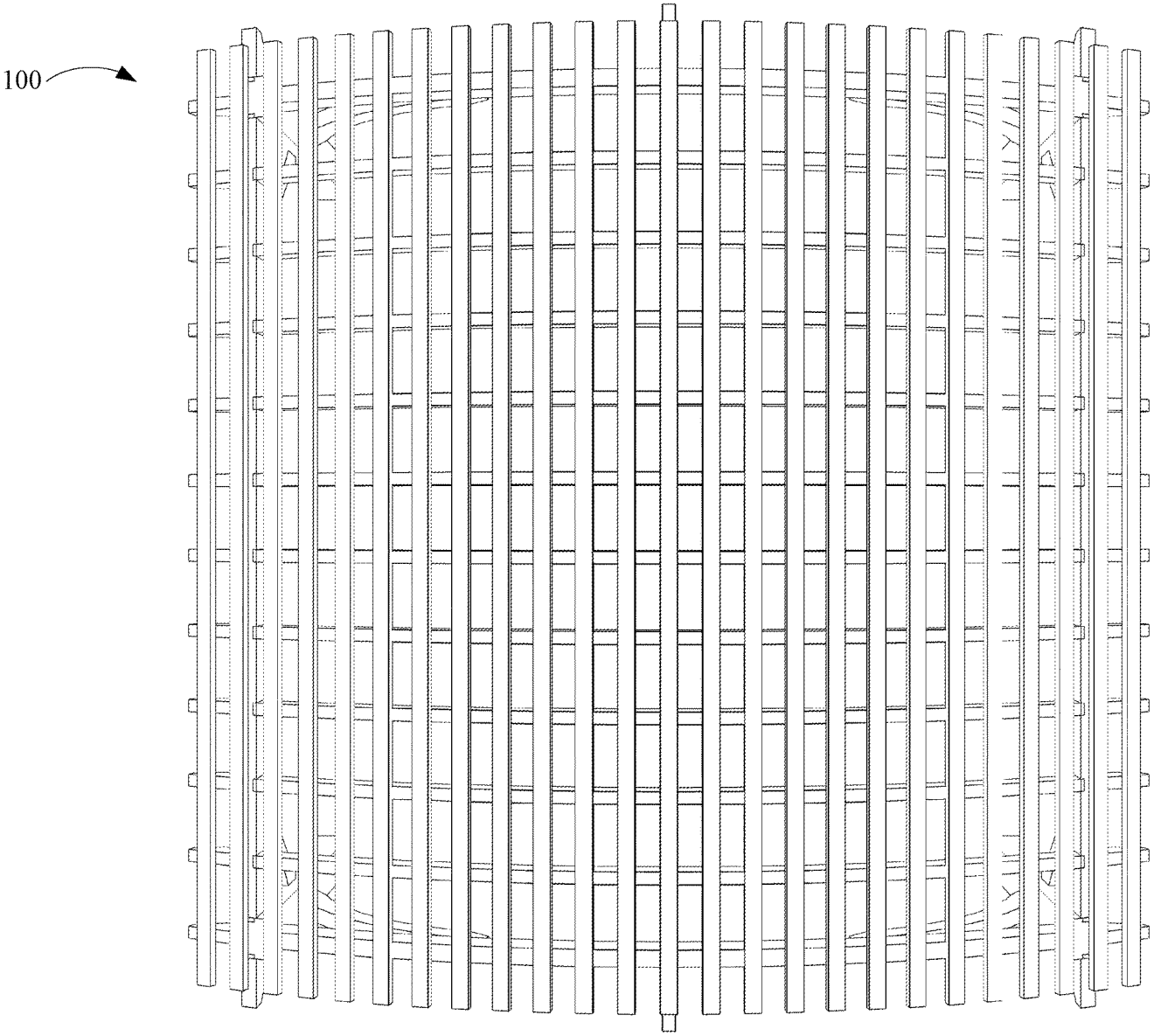
FIG. 2 is a top view of the timber frame structure shown in FIG. 1.
Figure 3:
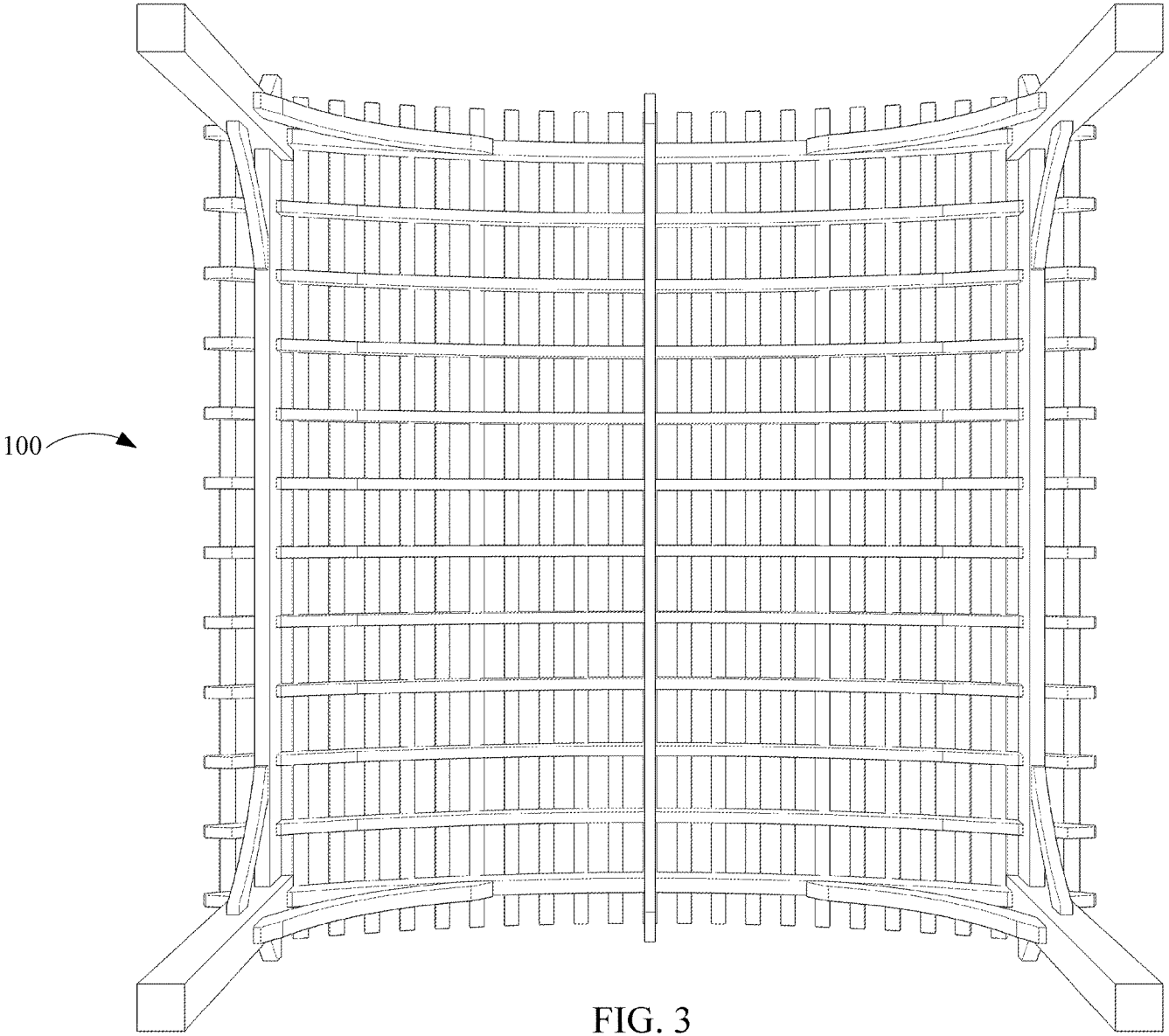
FIG. 3 is a bottom view of the timber frame structure shown in FIG. 1.

Referring back to FIG. 4, front and back arch supports 198 may be used to provide additional stability to the structure 100. Likewise, side arch supports 199 may also be used to provide additional stability to the structure 100. FIGS. 2 and 3 depict a top and bottom view of the structure 100, respectively.

Figure 8:
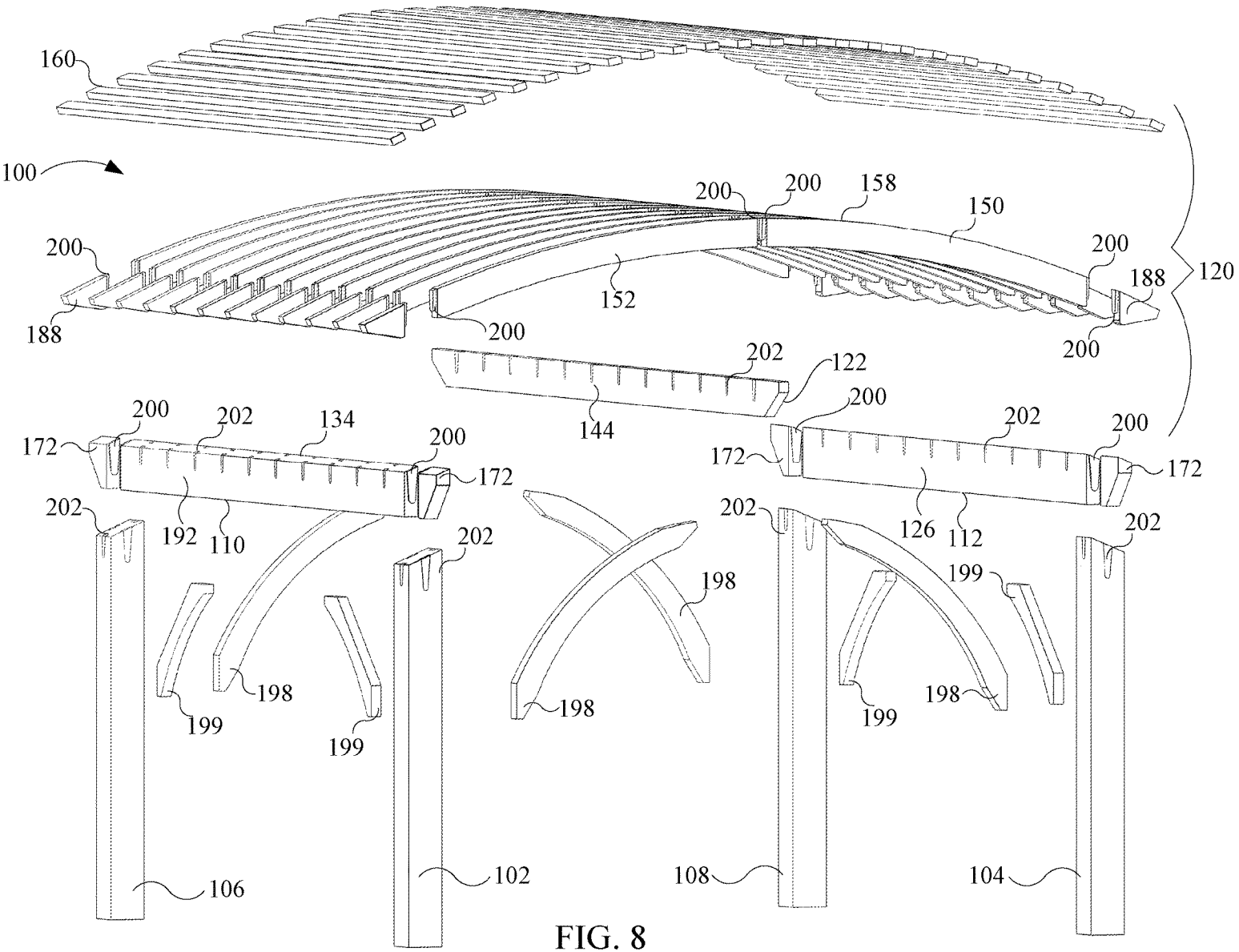
FIG. 8 is an exploded view of the timber frame structure shown in FIG. 1.
Figure 9:
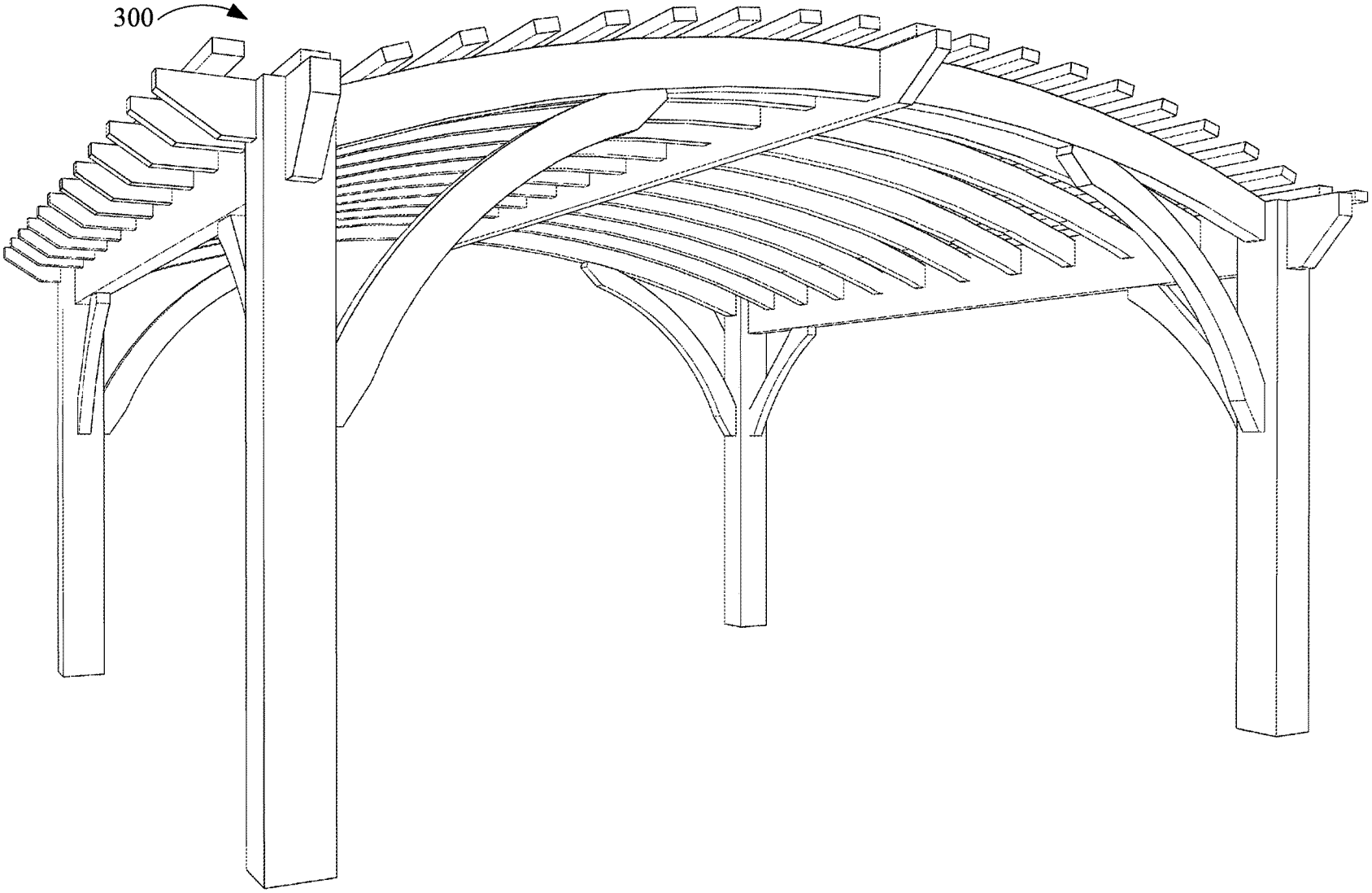
FIG. 9 is a perspective view of a timber frame structure with an arched roof according to an embodiment of the present disclosure.
Figure 10:
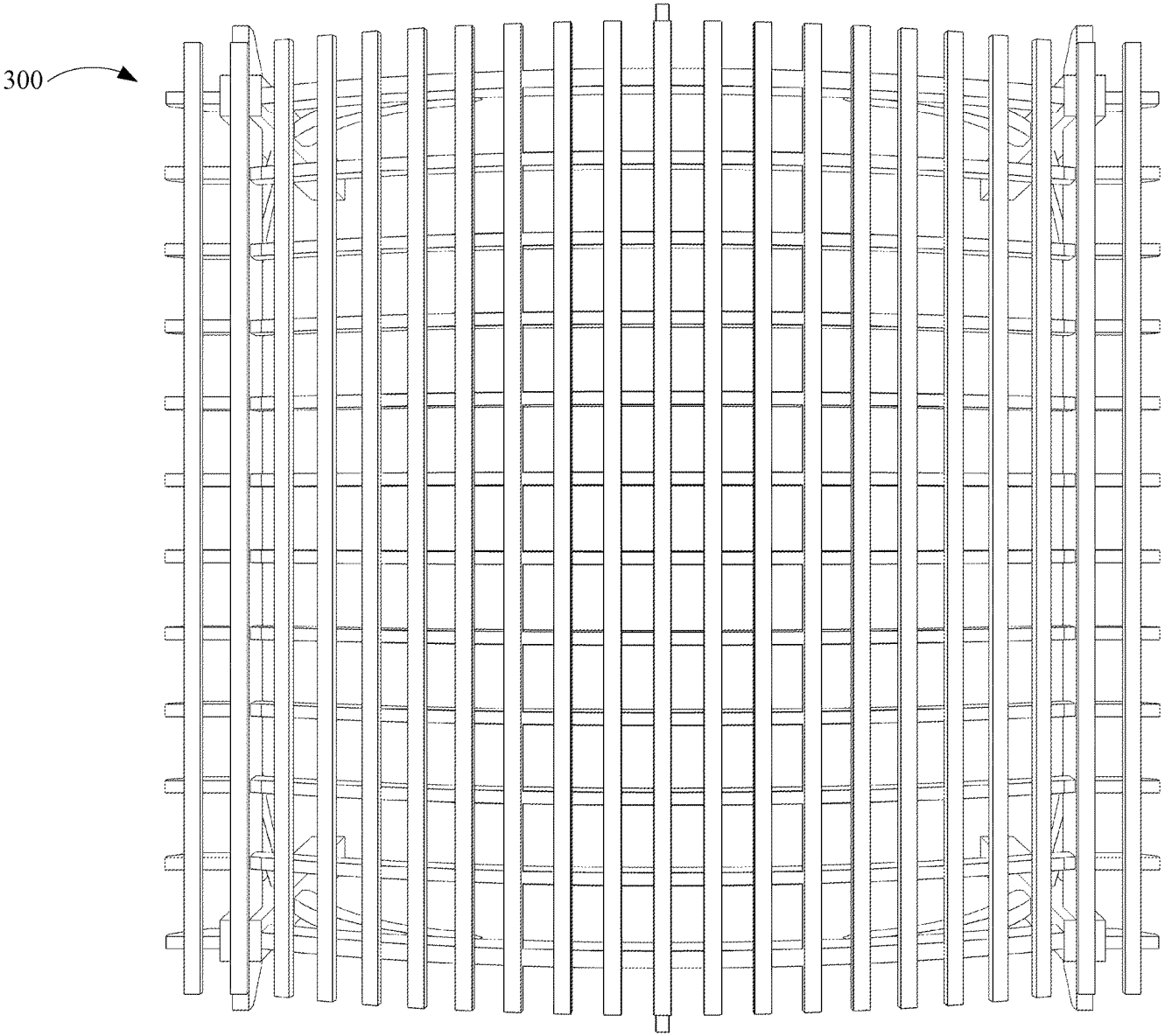
FIG. 10 is a top view of the timber frame structure shown in FIG. 9.
Figure 11:
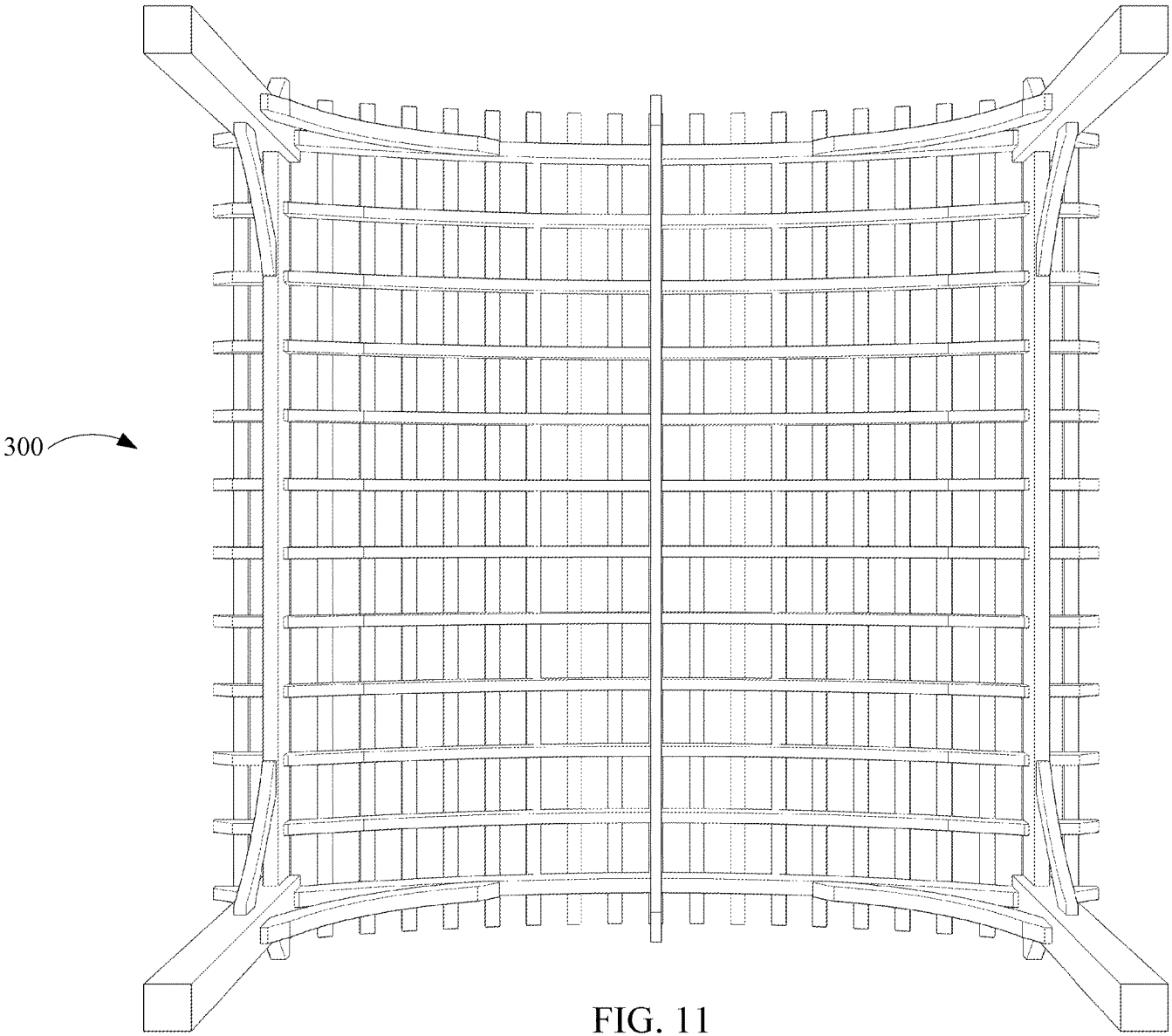
FIG. 11 is a bottom view of the timber frame structure shown in FIG. 9.
Figure 12:
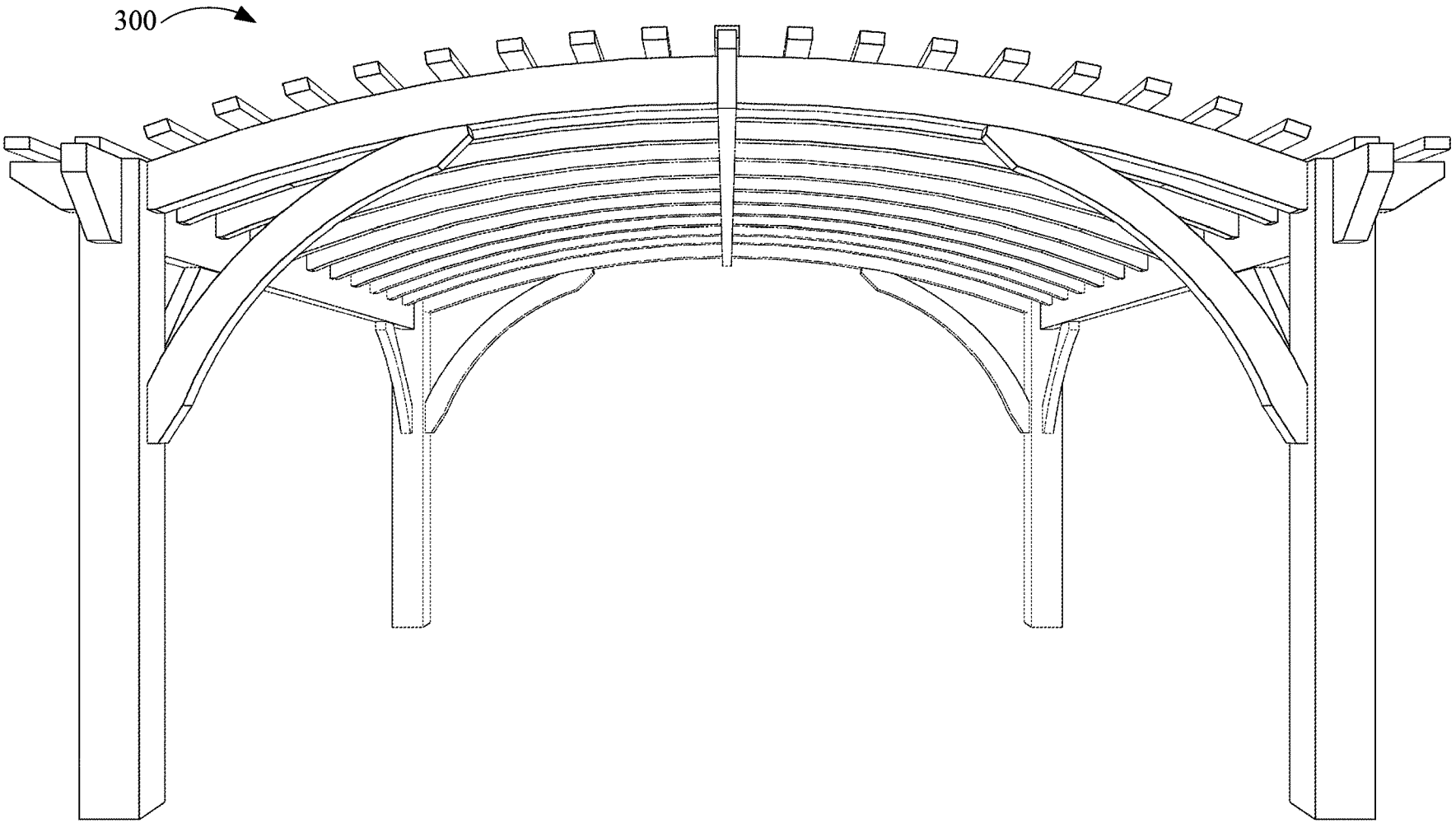
FIG. 12 is a front view of the timber frame structure shown in FIG. 9.
Figure 13:
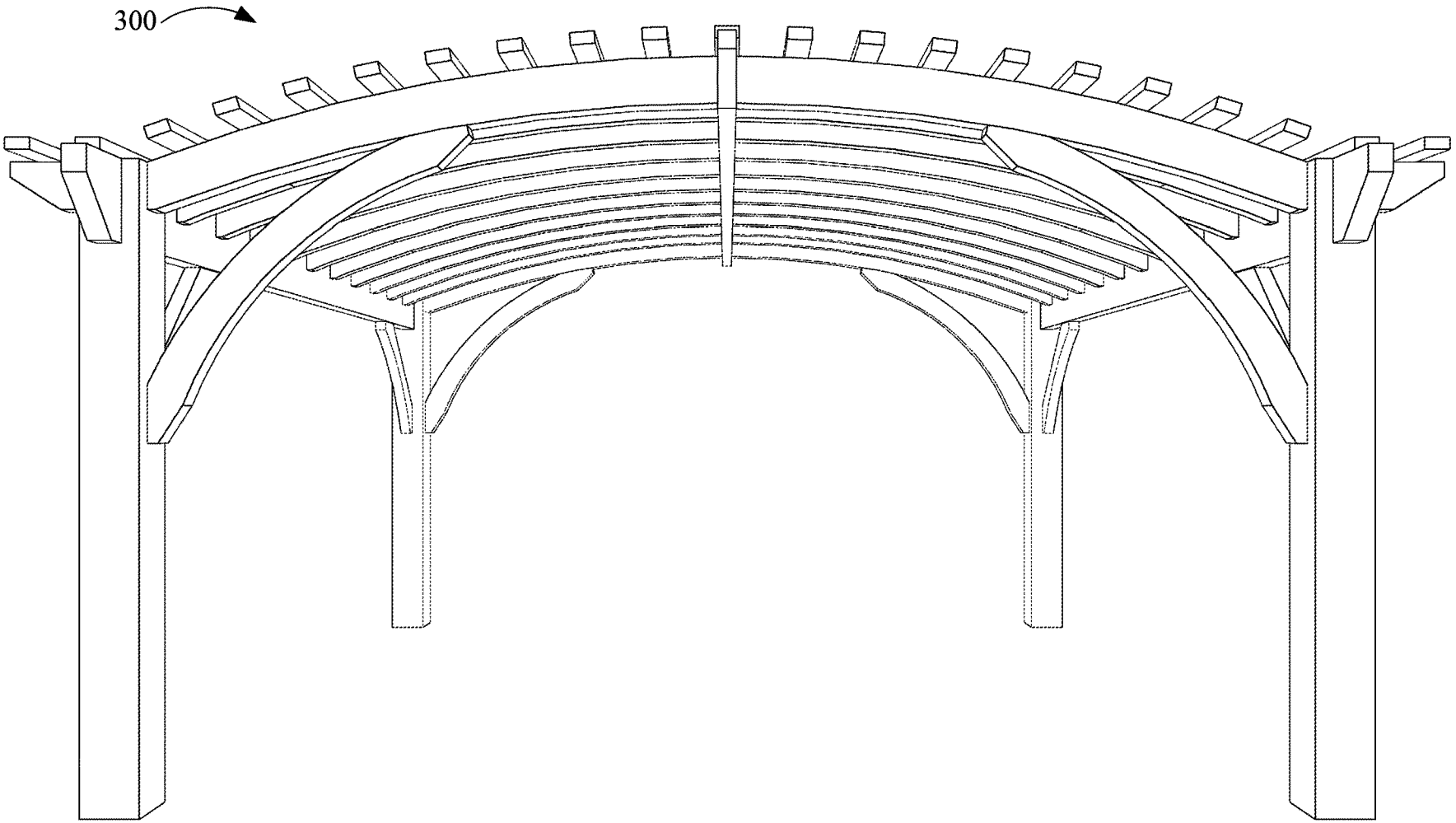
FIG. 13 is a rear view of the timber frame structure shown in FIG. 9.
Figure 14:
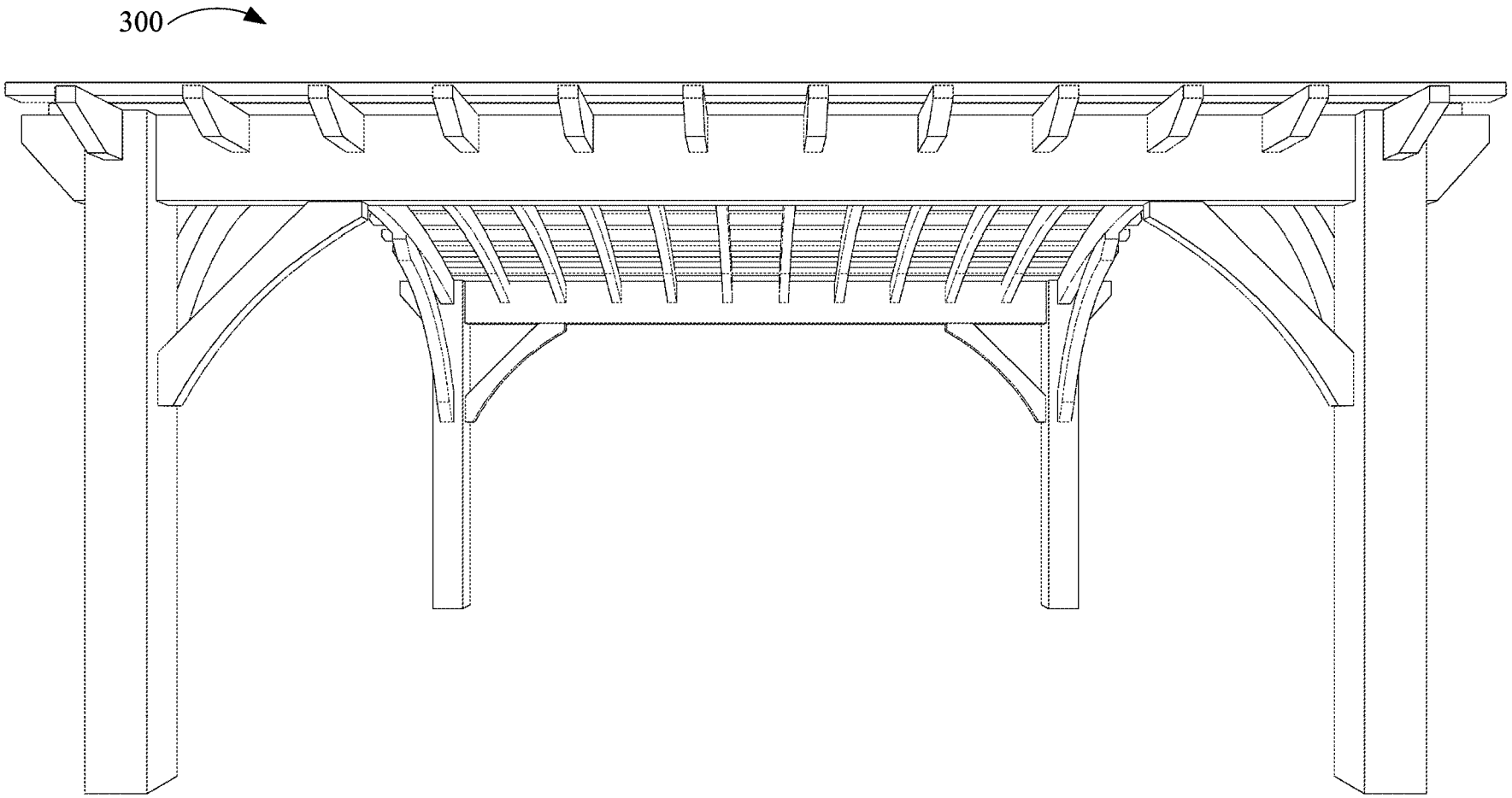
FIG. 14 is a right-side view of the timber frame structure shown in FIG. 9.
Figure 15:
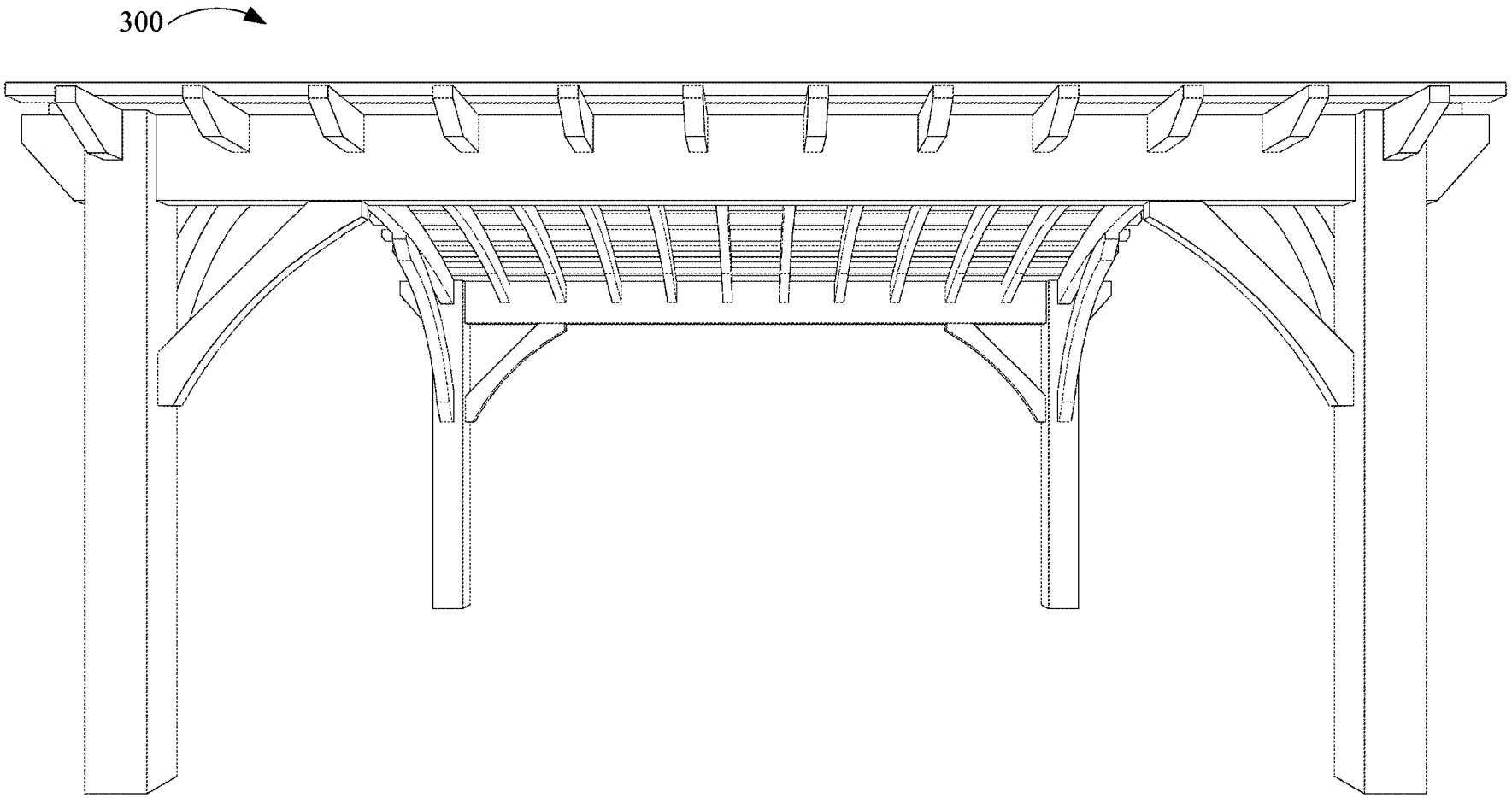
FIG. 15 is a left-side view of the timber frame structure shown in FIG. 9.
Figure 16:
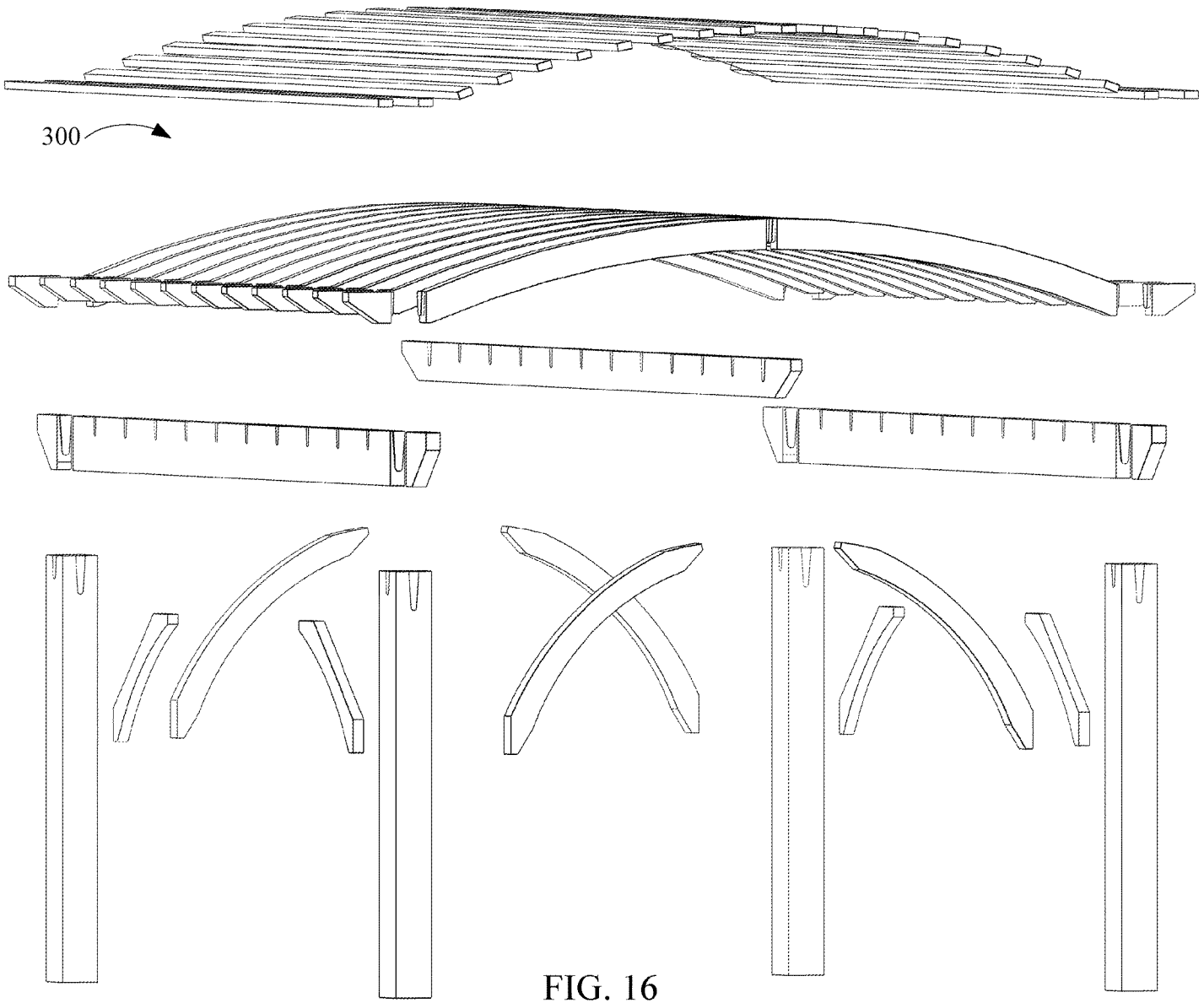
FIG. 16 is an exploded view of the timber frame structure shown in FIG. 9.
Figure 17:
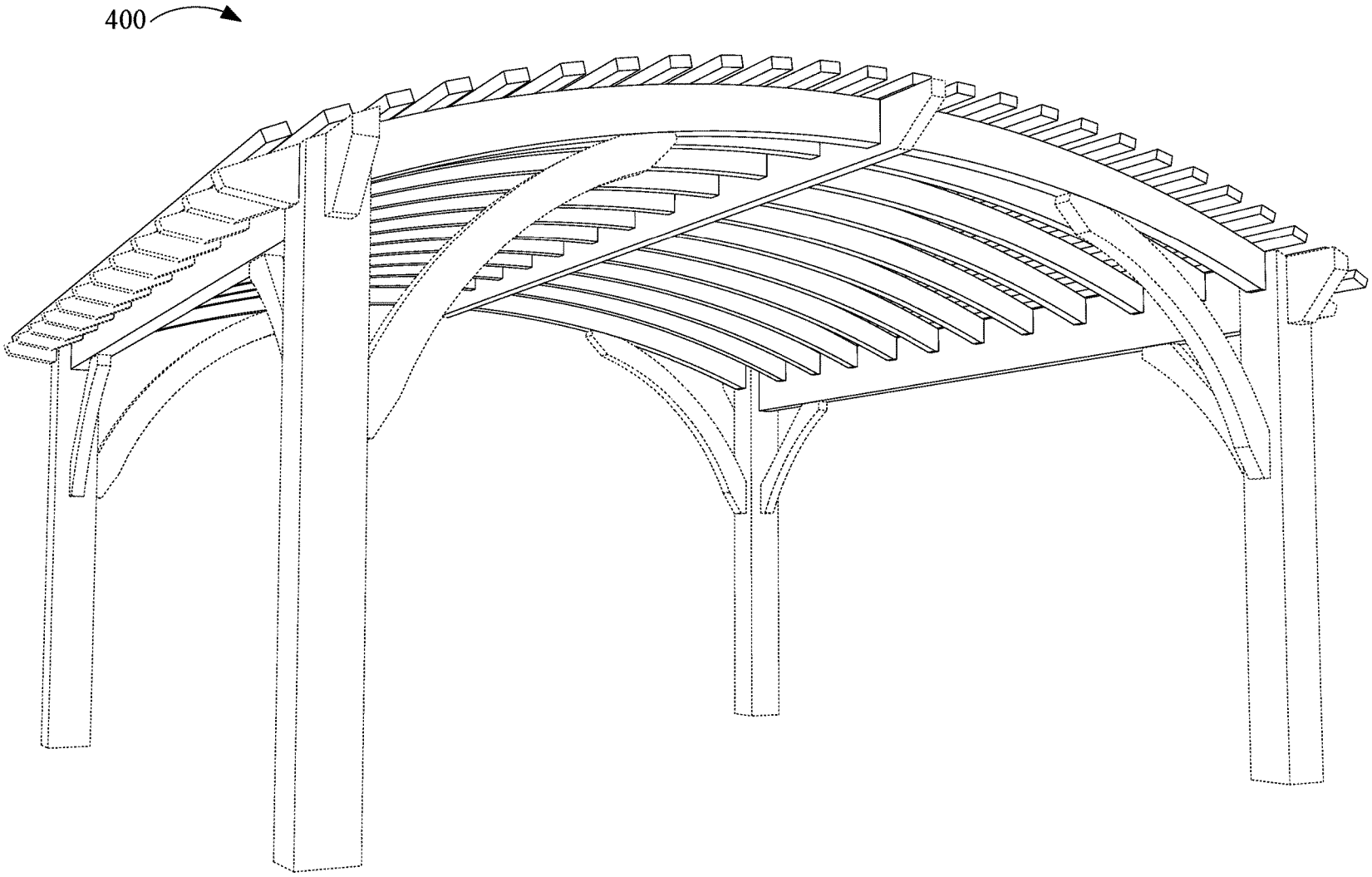
FIG. 17 is a perspective view of a timber frame structure with an arched roof according to an embodiment of the present disclosure.
Figure 18:
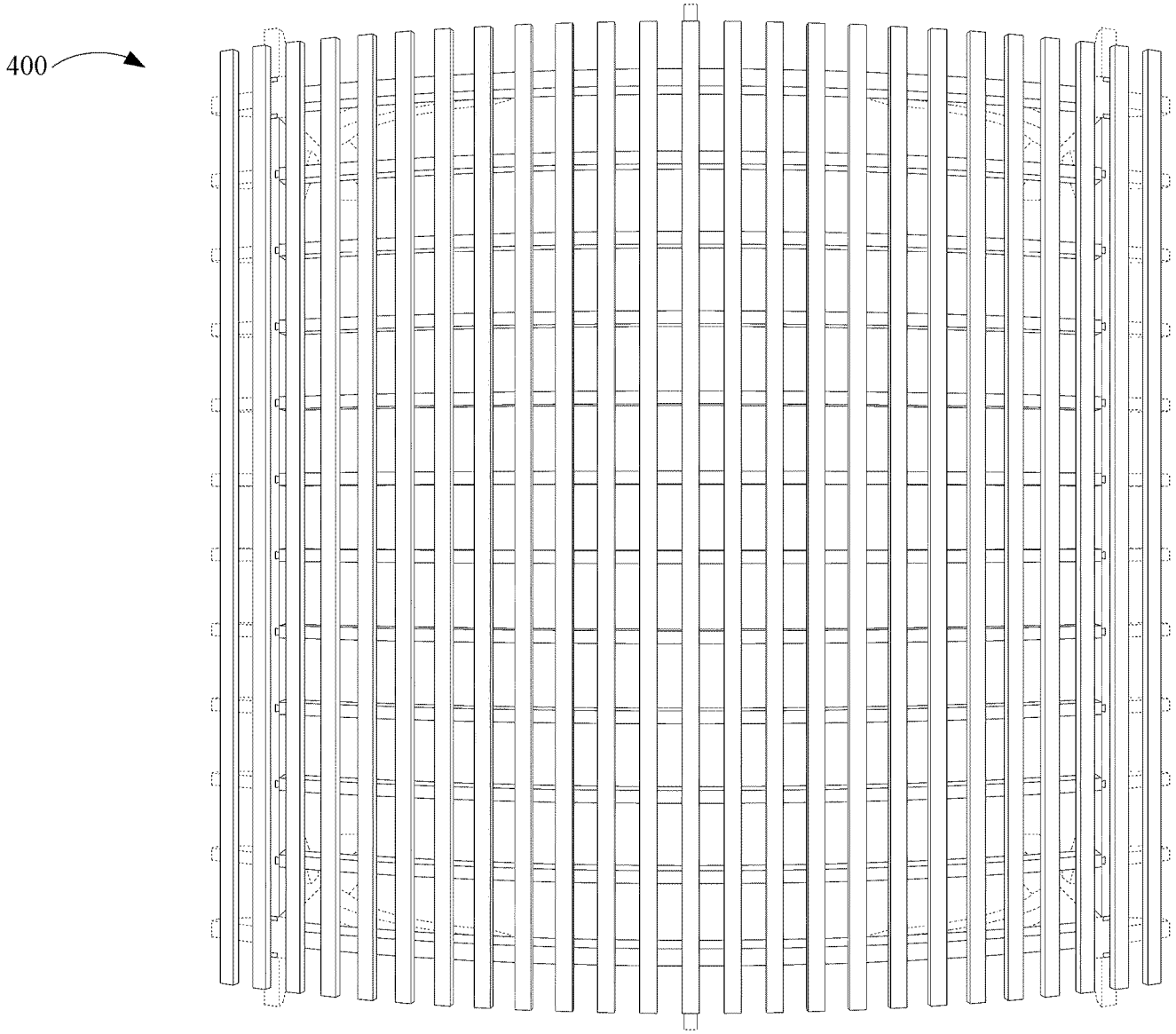
FIG. 18 is a top view of the timber frame structure shown in FIG. 17.
Figure 19:
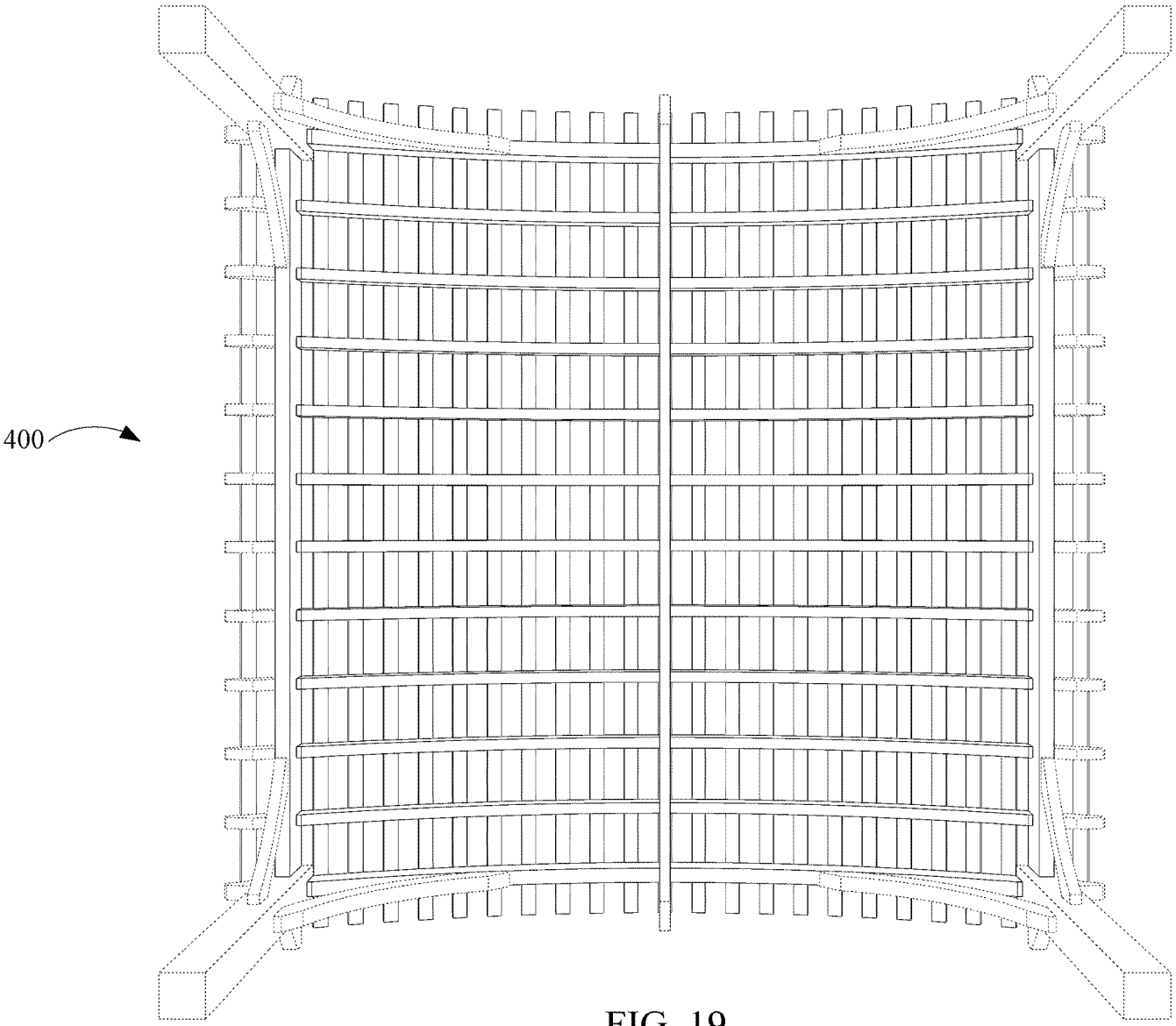
FIG. 19 is a bottom view of the timber frame structure shown in FIG. 17.
Figure 20:
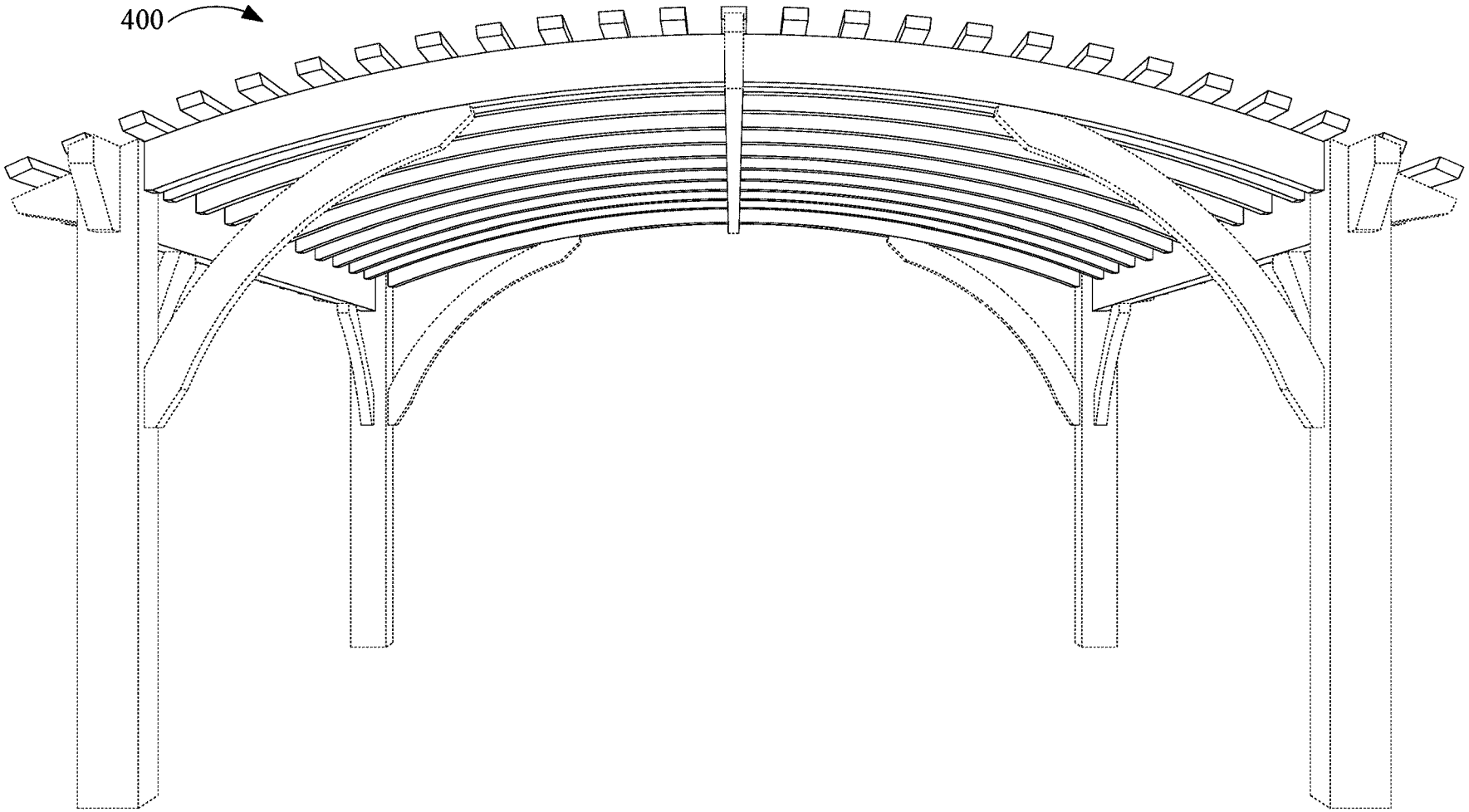
FIG. 20 is a front view of the timber frame structure shown in FIG. 17.
Figure 21:
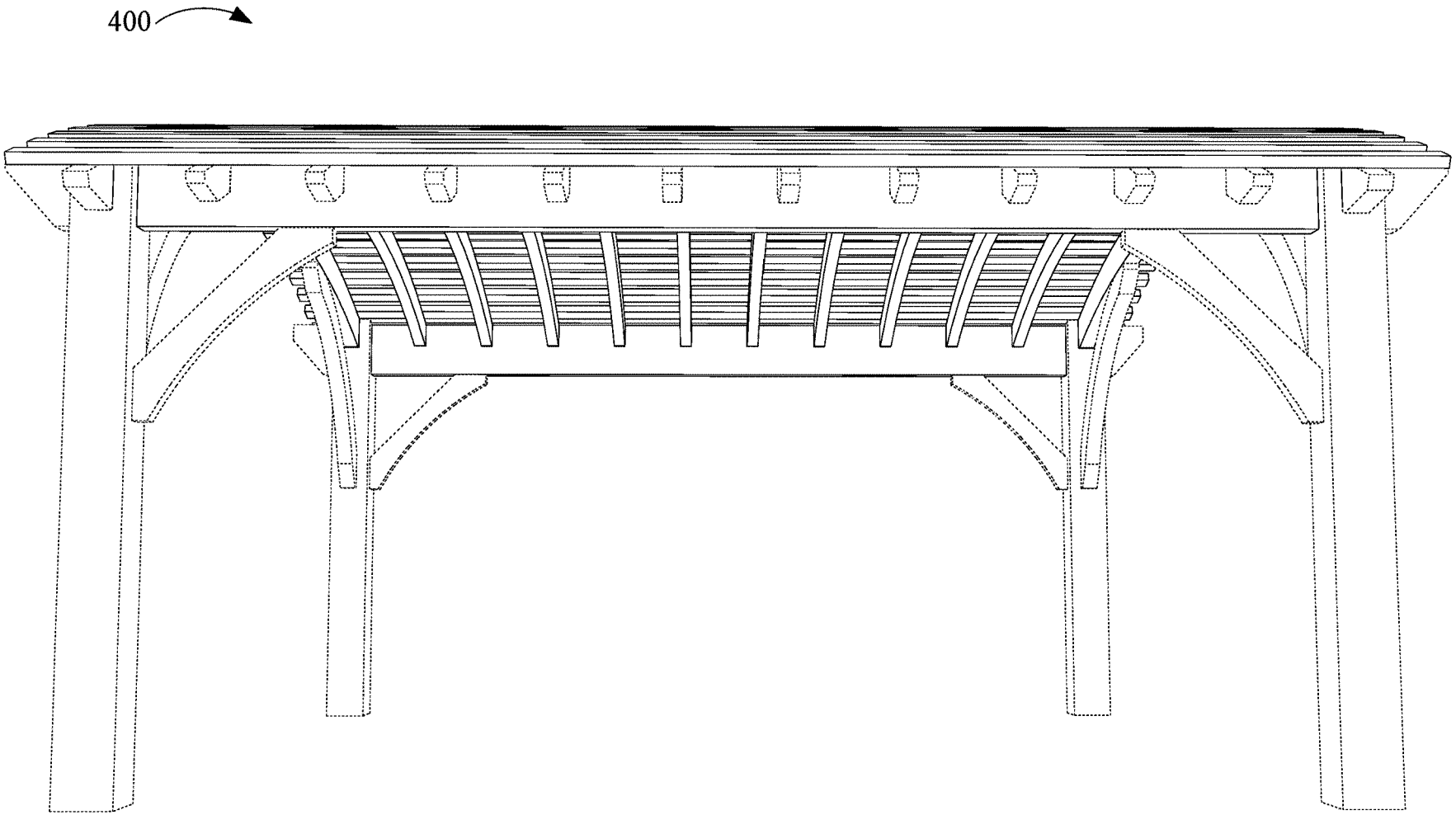
FIG. 21 is a right-side view of the timber frame structure shown in FIG. 17.
Figure 22:
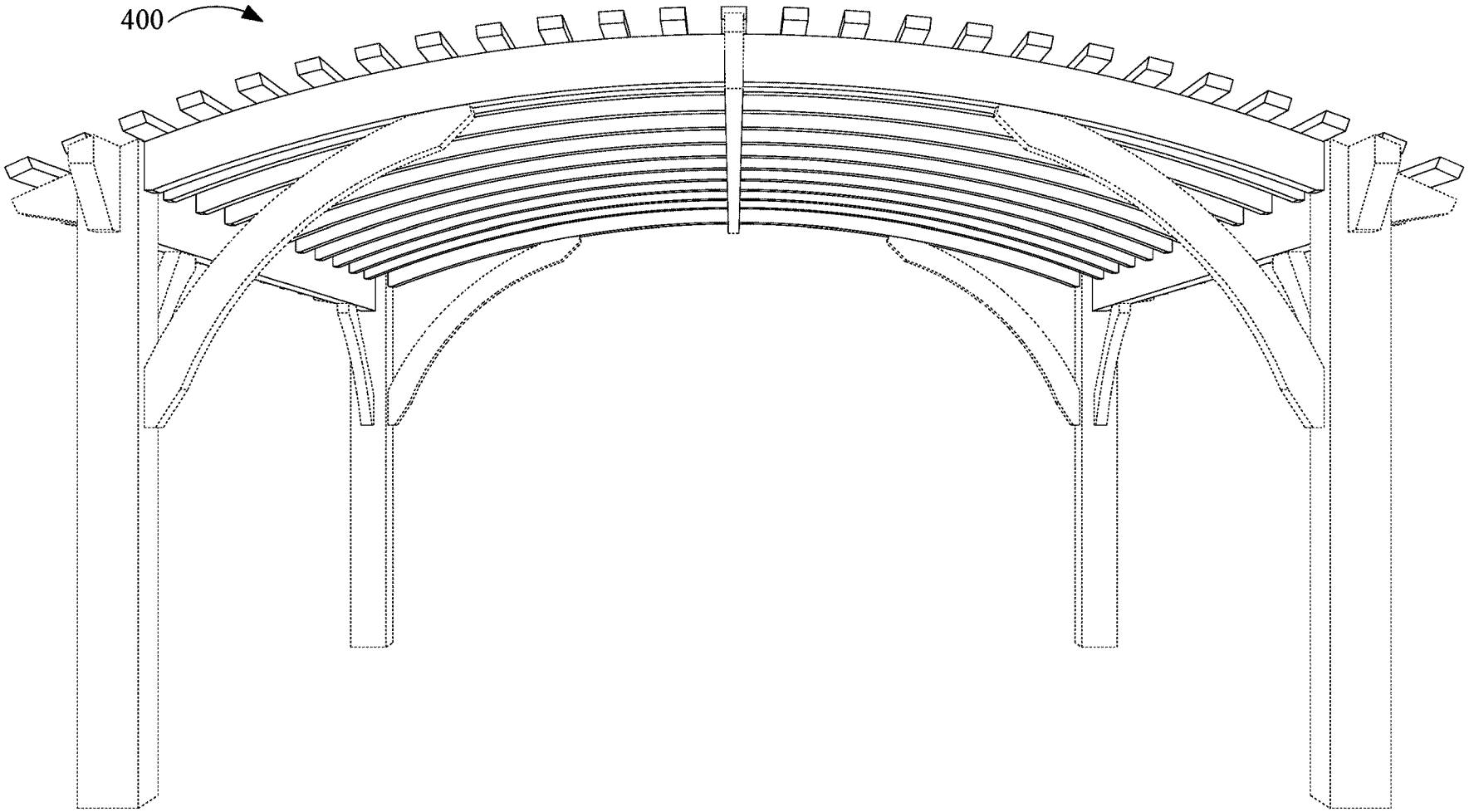
FIG. 22 is a rear view of the timber frame structure shown in FIG. 17.
Figure 23:
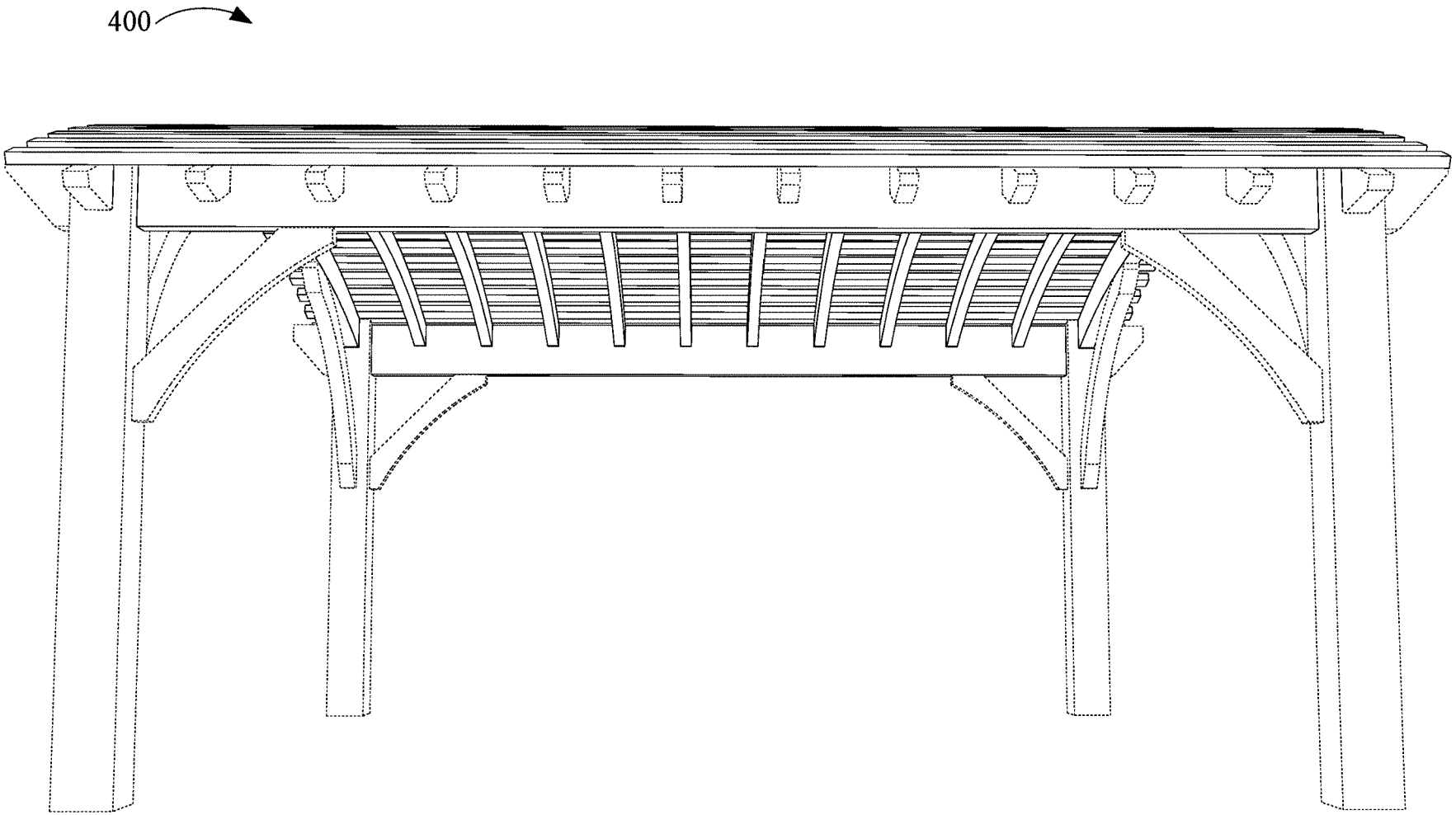
FIG. 23 is a left-side view of the timber frame structure shown in FIG. 17.
Figure 24:
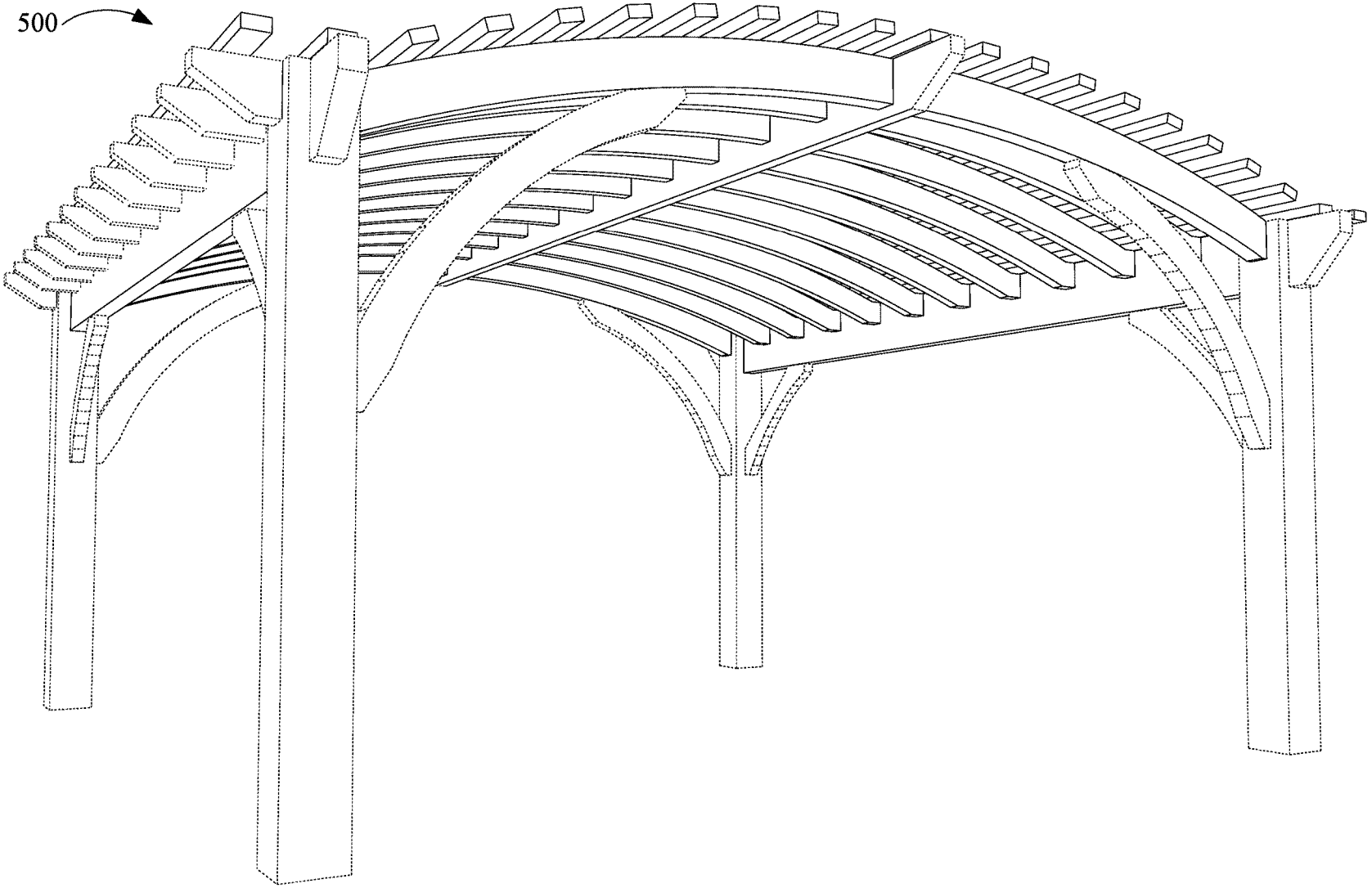
FIG. 24 is a perspective view of a timber frame structure with an arched roof according to an embodiment of the present disclosure.
Figure 25:
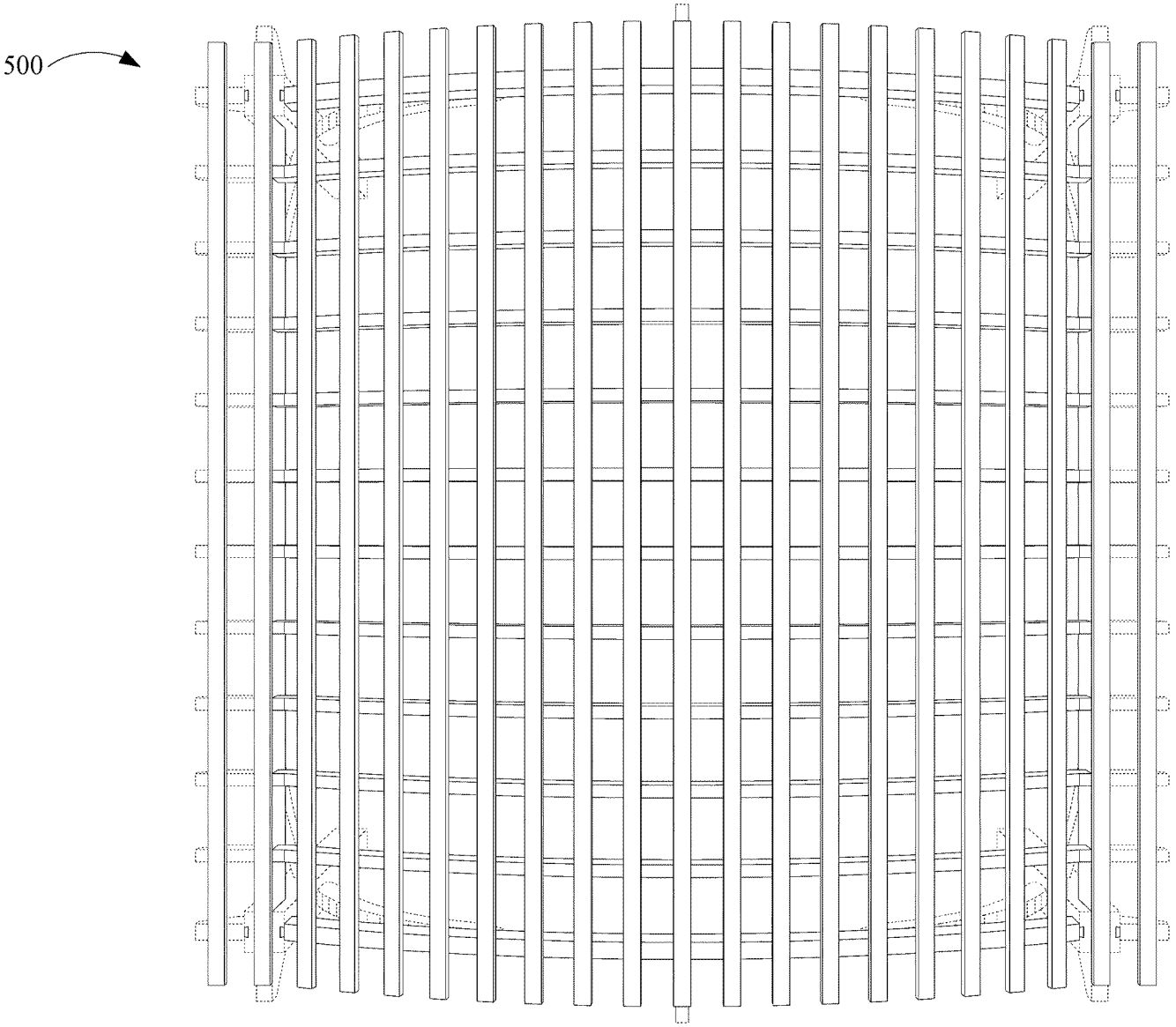
FIG. 25 is a top view of the timber frame structure shown in FIG. 24.
Figure 26:
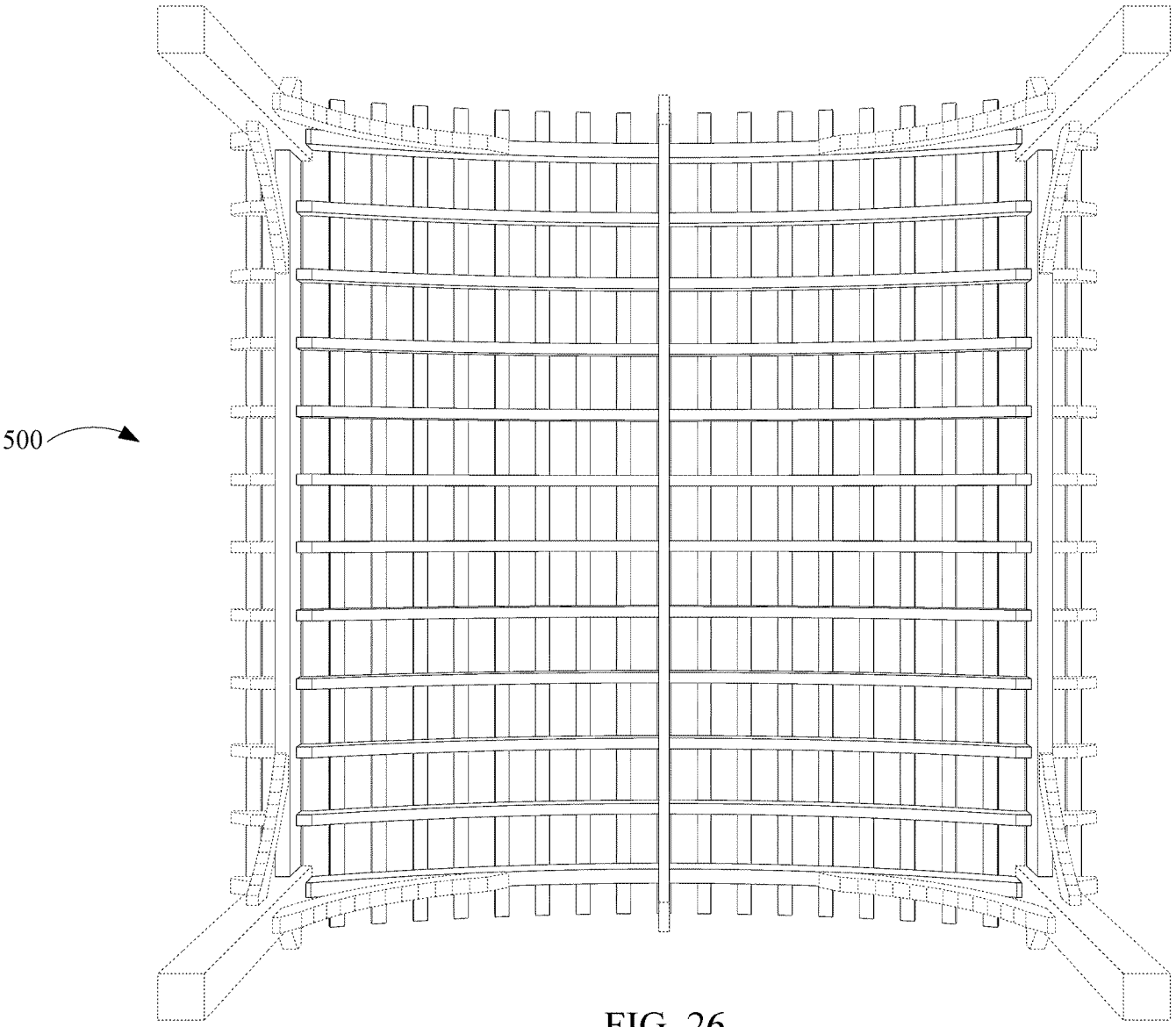
FIG. 26 is a bottom view of the timber frame structure shown in FIG. 24.
Figure 27:
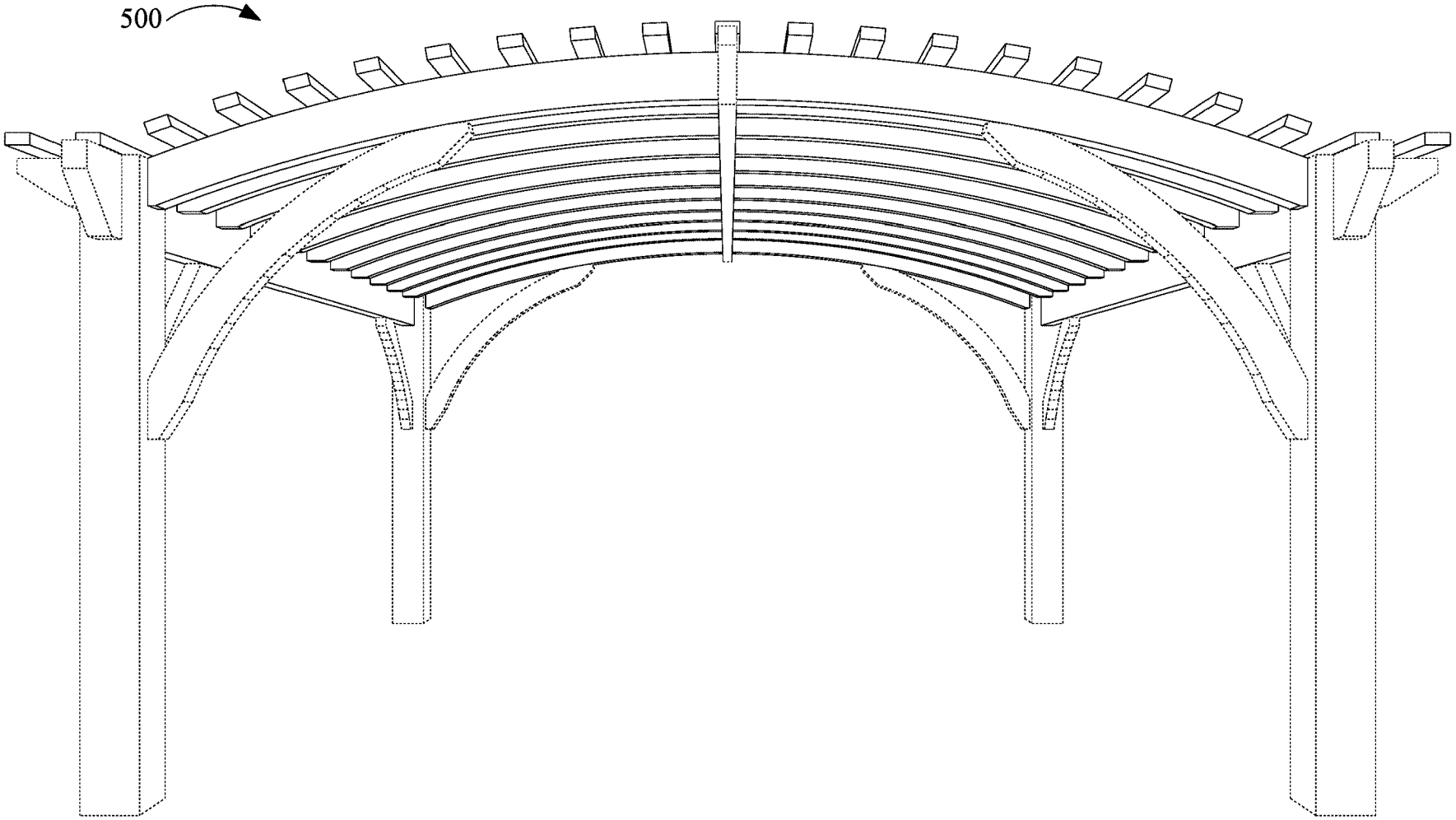
FIG. 27 is a front view of the timber frame structure shown in FIG. 24.
Figure 28:
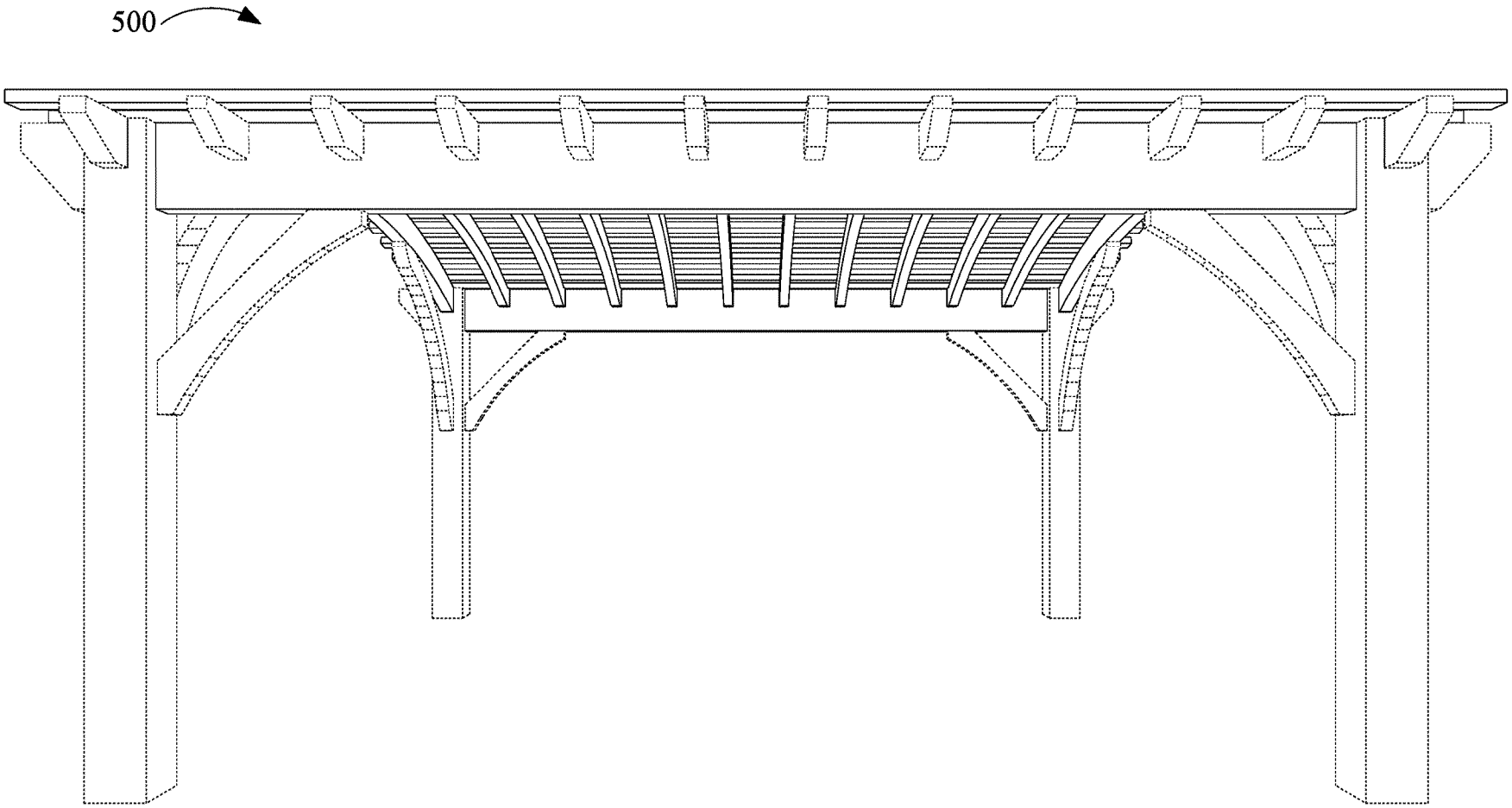
FIG. 28 is a right-side view of the timber frame structure shown in FIG. 24.
Figure 29:
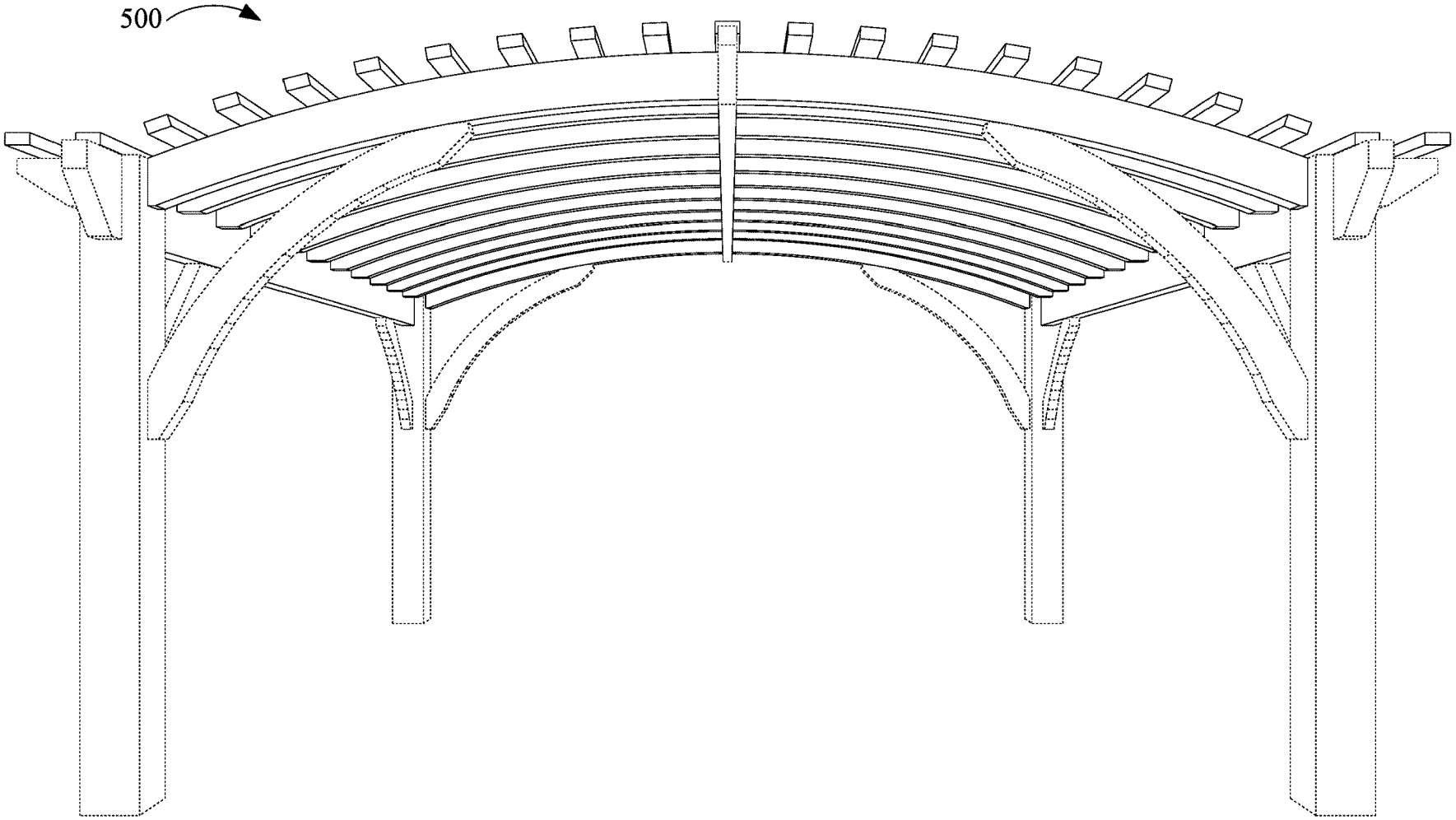
FIG. 29 is a rear view of the timber frame structure shown in FIG. 24.
Figure 30:
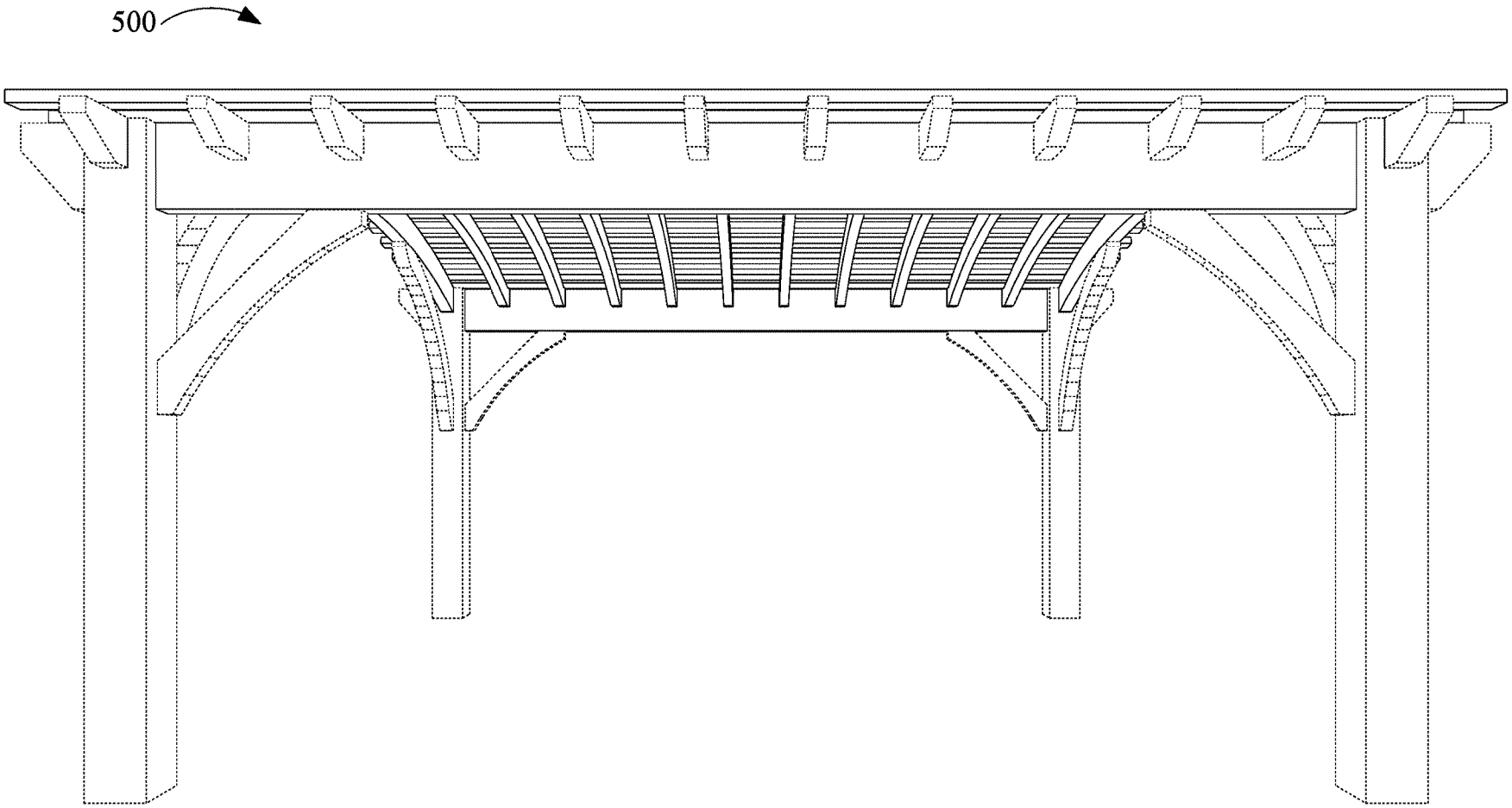
FIG. 30 is a left-side view of the timber frame structure shown in FIG. 30.

Referring to FIG. 8, where like reference numerals depict like components, the joinery of the various components of the structure 100 will now be described. Some of the components of the structure 100 are joined using dovetail joints comprising a dovetail 200 and a socket 202, as indicated. The first support beam 110 is joined to the posts 102 and 106 using dovetail joints. The second support beam 112 is joined, to the posts 104 and 108 using dovetail joints. The corbels 172 are attached to the posts using dovetail joints. The arch supports 198 and 199 are connected using fasteners, such as lag bolts (not shown). The curved rafters 150 are connected to the key beam 122 and the second support beam 112 using dovetail joints. The curved rafters 152 are connected to the key beam 122 and the first support beam 110 using dovetail joints. The top planks 160 are connected to the curved mounting surface 158 using fasteners, such as nails or screws (not shown).

As mentioned above, the components of the structure 100 may be pre-manufactured such that the structure 100 is sold and shipped as an unassembled kit. In this regard, the components of the structure 100 may be pre-cut to length from wood, and, in particular, from heavy timber rather than dimensional lumber. The components of the structure 100 may be further configured to join using joinery techniques common to the timber frame industry.

Referring to FIGS. 9-16, there is depicted a timber frame structure 300 according to the present disclosure. Referring to FIGS. 17-23, there is depicted a timber frame structure 400 according to the present disclosure, where the broken lines show environmental structure or boundaries that form no part of a design to be patented in a design patent claiming priority to this patent application. Referring to FIGS. 24-30, there is depicted a timber frame structure 500 according to the present disclosure, where the broken lines show environmental structure or boundaries that form no part of a design to be patented in a design patent claiming priority to this patent application.

In the foregoing Detailed Description, various features of the present disclosure are grouped together in a single embodiment for streamlining the disclosure. This method of disclosure is not to be interpreted as reflecting an intention that the claimed disclosure requires more features than are expressly recited in each claim. Rather, as the following claims reflect, inventive aspects lie in less than all, features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it, will be apparent to those of ordinary skill in the art that numerous modifications, including, but not limited to, variations in size, materials, shape, form, function and manner of operation, assembly and use may be made without departing from the principles and concepts set forth, herein.

What is claimed is:

1. A timber frame structure comprising:

a plurality of support posts;

a first mounting surface extending between a first pair of the plurality of support posts;

a second mounting surface extending between a second pair of the plurality of support posts;

a plurality of arches; and each of the arches having a first end and a second end;

wherein the first end of each of the plurality of arches are joined to the first mounting surface and the second end of each of the plurality of arches are joined to the second mounting surface;

a key beam;

wherein each of the plurality of arches comprises a first curved rafter and a second curved rafter, wherein each of the first curved rafters comprises a first end joined to the key beam and each of the second curved rafters comprises a first end joined to the key beam;

wherein the key beam extends between each of the plurality of arches;

wherein each of the plurality of arches comprises a curved top surface;

a plurality of top planks each having a bottom surface;

wherein the top planks are mounted onto the plurality of arches such that the bottom surface of each of the top planks abuts against the curved surface of each the plurality of arches.

2. The timber frame structure of claim 1, wherein the first mounting surface comprises a first support beam extending between the first pair of the plurality of support posts.

3. The timber frame structure of claim 2, wherein the second mounting surface comprises a second support beam extending between the second pair of the plurality of support posts.

4. The timber frame structure of claim 1, wherein the key beam is located at an apex of the plurality of arches.

5. The timber frame structure of claim 1, wherein the plurality of arches is self-supporting.

6. The timber frame structure of claim 1, wherein the first end of each of the plurality of arches are joined to the first mounting surface using dovetail joints.

7. The timber frame structure of claim 6, wherein the second end of each of the plurality of arches are joined to the second mounting surface using dovetail joints.

* * * * *